US008745923B2

(12) United States Patent
Khoshkish

(10) Patent No.: US 8,745,923 B2
(45) Date of Patent: Jun. 10, 2014

(54) DOOR VIEWER SECURITY COVER

(76) Inventor: Kamran Khoshkish, Tehran (IR)

( * ) Notice: Subject to any disclaimer, the term of this patent is extended or adjusted under 35 U.S.C. 154(b) by 0 days.

(21) Appl. No.: 13/602,555

(22) Filed: Sep. 4, 2012

(65) Prior Publication Data

US 2013/0118083 A1 May 16, 2013

Related U.S. Application Data

(63) Continuation-in-part of application No. 13/295,121, filed on Nov. 14, 2011.

(51) Int. Cl.
*E06B 7/28* (2006.01)

(52) U.S. Cl.
USPC ..... 49/171

(58) Field of Classification Search
USPC ..... 49/163, 169, 171
See application file for complete search history.

(56) References Cited

U.S. PATENT DOCUMENTS

| | | | | | |
|---|---|---|---|---|---|
| 593,993 | A | | 11/1897 | Elwood | |
| 868,677 | A | * | 10/1907 | Lyon | 181/19 |
| 1,461,487 | A | | 7/1923 | Laibach | |
| 1,648,279 | A | * | 11/1927 | Mumbrauer | 49/171 |
| 1,737,292 | A | | 11/1929 | Bauer | |
| 2,124,525 | A | * | 7/1938 | Frankel | 49/171 |
| 2,169,874 | A | * | 8/1939 | Hardt | 359/504 |
| 2,229,594 | A | * | 1/1941 | Seiler | 359/629 |
| 2,286,353 | A | * | 6/1942 | Ehehalt, Jr. | 359/636 |
| 2,304,995 | A | * | 12/1942 | Frankel | 49/171 |
| 2,581,234 | A | * | 1/1952 | Bloom | 359/629 |
| 3,594,062 | A | | 7/1971 | Disley | |
| 4,127,967 | A | * | 12/1978 | Franzl | 49/171 |
| 4,245,566 | A | * | 1/1981 | Shimansky et al. | 109/49.5 |
| 4,644,687 | A | | 2/1987 | Liou | |
| 4,719,720 | A | * | 1/1988 | Olsen | 49/171 |
| 5,456,095 | A | * | 10/1995 | Tawil et al. | 63/29.1 |
| 5,518,175 | A | * | 5/1996 | Yeremian | 232/19 |
| 5,623,367 | A | | 4/1997 | Immel | |
| 5,671,564 | A | | 9/1997 | Lyle | |
| 5,883,738 | A | * | 3/1999 | Funatsu | 359/409 |
| 6,254,303 | B1 | * | 7/2001 | Falat et al. | 403/348 |
| 6,779,305 | B2 | | 8/2004 | Harter | |
| 2003/0204997 | A1 | | 11/2003 | Harter | |
| 2011/0099907 | A1 | * | 5/2011 | Anderson et al. | 49/171 |

FOREIGN PATENT DOCUMENTS

| | | | |
|---|---|---|---|
| JP | 2001040958 | A | 2/2001 |
| JP | 2006183307 | A | 7/2006 |

OTHER PUBLICATIONS

Search Report and Written Opinion from PCT/US2012/053728.

* cited by examiner

*Primary Examiner* — Katherine Mitchell
*Assistant Examiner* — Scott Denion
(74) *Attorney, Agent, or Firm* — Edell, Shapiro & Finnan, LLC

(57) ABSTRACT

The present invention is directed toward a security cover for a door viewer such as a peephole. The security cover includes a housing having a forward opening configured to align with the peephole, a rearward viewing port, and an eyecup. The security cover further includes a shutter mechanism that is manually repositionable from a closed position to an opened position via engagement of an actuator. In operation, the security cover is coupled to a door such that it covers the door viewer.

20 Claims, 30 Drawing Sheets

DOOR VIEWER SECURITY COVER

CROSS REFERENCE TO RELATED APPLICATIONS

The present application is a continuation-in-part of application Ser. No. 13/295,121, filed on 14 Nov. 2011 and entitled "Door Viewer Security Cover," the disclosure of which is incorporated herein by reference in its entirely

FIELD OF THE INVENTION

The present invention relates to a security cover for a door viewer device such as a peephole.

BACKGROUND OF THE INVENTION

Door viewer devices such as peepholes are security devices that permit a viewer located on one side of the door (e.g., the inside of the door) to observe callers located on the other side of the door (e.g., the outside of the door). Such door viewer devices typically include a lens system that generates a virtual image of the various objects located in front of the door. In operation, a user positioned behind the door peers through the door viewer device to view the immediate area surrounding the door, thereby enabling the person to confirm the identity of persons or objects before opening the door. Conventional door viewer devices suffer from several disadvantages. First, conventional door viewer devices permit two-way viewing. That is, while door viewer devices permit the viewer on the inside to view the area located in front of the door, they further permit a viewer positioned in front of the door to view the area proximate the rear side of the door. In addition, conventional door viewer devices permit outside viewers (i.e., persons located in front of the door) to view changes in light that occur when the insider viewer approaches the door and looks through the peephole. By noting changes in light within the peephole (e.g., from light to dark), the outside viewer is alerted to the fact that someone is located within the structure (e.g., the home, apartment, business, etc.) and is positioned behind the door, which compromises the security of the persons located within the structure.

Thus, it would be desirable to provide a security device that prevents outside viewers from viewing into the secured area (e.g., a house, office, etc.), as well as enables an insider viewer to look through the door viewer device without generating changes in light that might occur during viewing.

SUMMARY OF THE INVENTION

The present invention is directed toward a security cover for a door viewer device such as a peephole. The security cover includes a housing including a forward aperture, a rearward aperture aligned with the forward aperture, and a shutter mechanism disposed between the apertures. The shutter mechanism is repositionable from a closed position to an opened position via engagement of an actuator. In operation, the security cover is coupled to a door such that the cover encloses the peephole and the forward aperture is aligned with the viewing port of the peephole. The cover may further include an eyecup secured to the rearward plate.

BRIEF DESCRIPTION OF THE DRAWINGS

Like reference numerals have been used to identify like elements throughout this disclosure.

DETAILED DESCRIPTION OF THE INVENTION

Figure 1A:
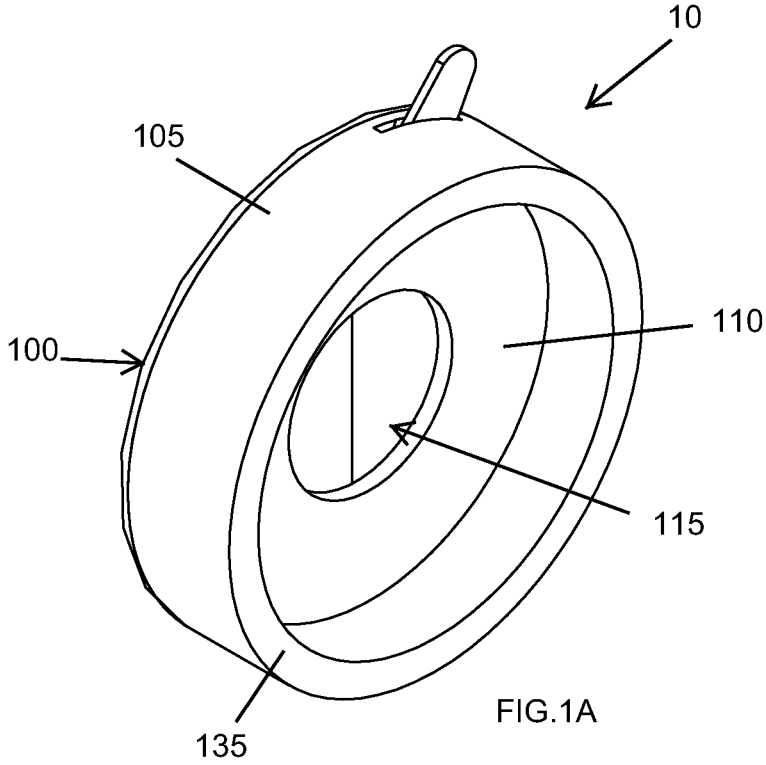
FIG. 1A illustrates a front perspective view of a security cover for a door viewer in accordance with an aspect of the present invention.
Figure 1B:
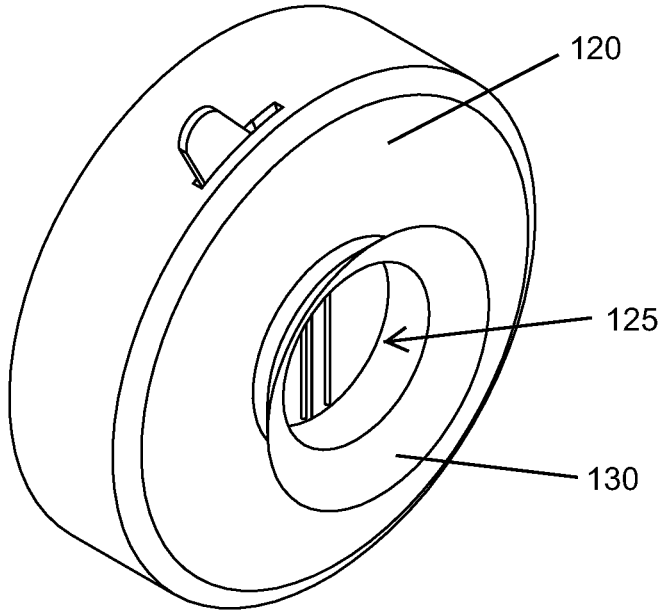
FIG. 1B illustrates a rear perspective view of the security cover shown in FIG. 1A.

FIGS. 1A and 1B illustrate a security cover for a door viewer in accordance with an embodiment of the invention. As shown, the security cover 10 includes a body or housing 100 having a generally cylindrical side wall 105, a forward plate 110 including a forward aperture 115, and a rearward plate 120 including a rearward or viewing aperture 125. An eyecup or eye shield 130 (e.g., similar to those found on binoculars) is coupled to the rearward plate 120, surrounding the viewing aperture. As shown, the forward plate 110 is housed within the body 100, being axially spaced from body forward end. The forward plate defines a forward, generally annular rim 135 operable to contact the door surface. The rim 135 may be treated such that it couples to the door surface. By way of example, the rim 135 may be coated with an adhesive. In other embodiments, the security cover 10 may include one or more fastening members (e.g., grommets) extending radially from the body 100 to permit fasteners such nails or screws to be utilized to secure the cover 10 to the door. In operation, the security cover 10 is connected to the rear surface of a door such that the rim 135 surrounds the viewing port of the door viewer, and such that the forward aperture generally aligns with the viewing port. Once connected to the door, the inside viewer (i.e., the person located on the back side (or inside) of the door) places an eye against the eyecup 130, looks through the rearward 125 and forward 115 apertures and through the door viewer.

Figure 2:
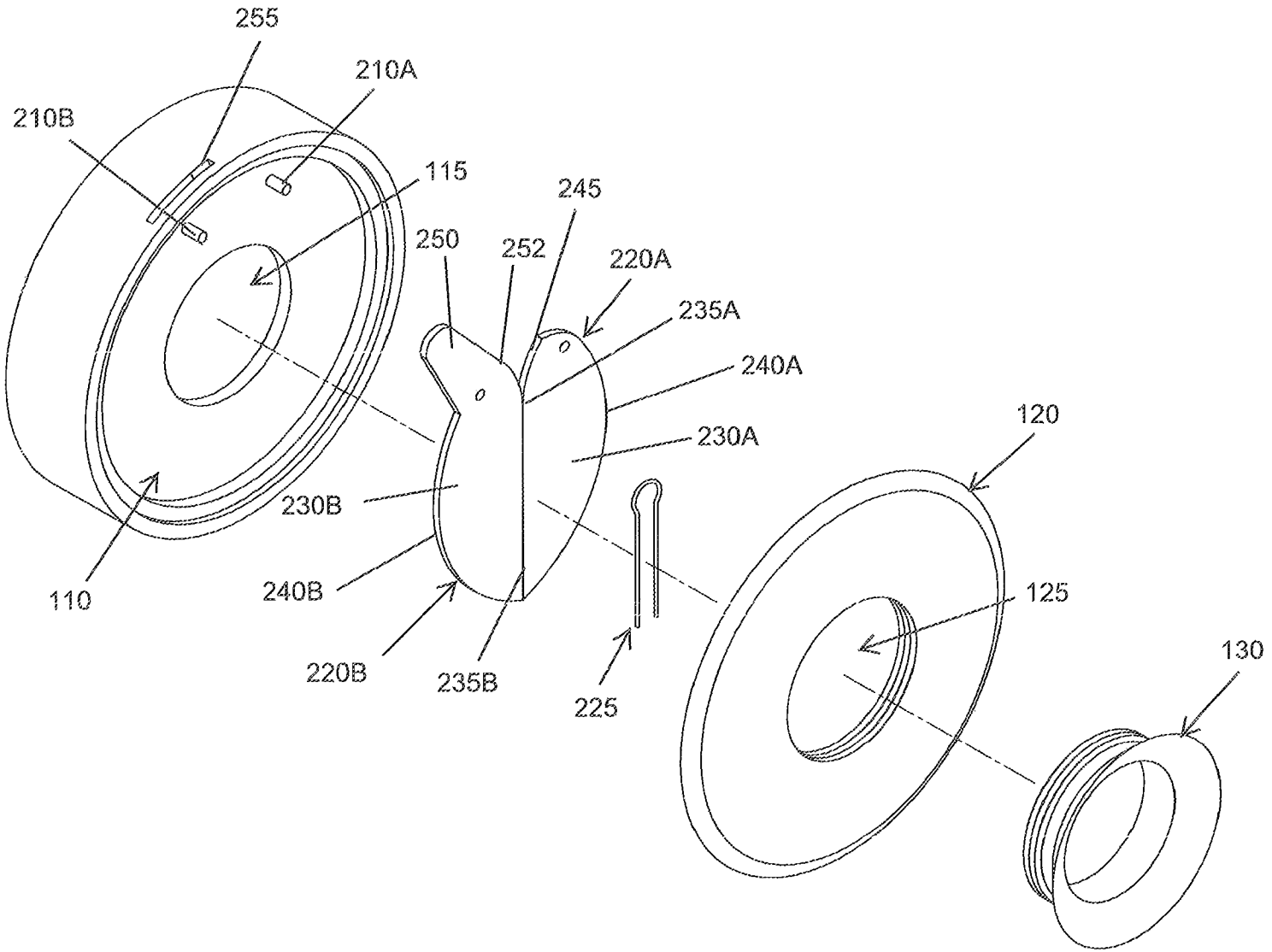
FIG. 2 illustrates an exploded view of the security cover shown in FIG. 1A.

The security cover 10 further includes a shutter mechanism disposed between the apertures 115, 125 operable to selectively open and close the viewing aperture 125. Referring to FIG. 2, the rear side 205 of the forward plate 110 includes a first post 210A laterally spaced from a second post 210B. Each post 210A, 210B extends axially from the rear side or the forward plate 110. A first shutter member 220A is pivotally mounted on the first post 210A and a second shutter member 220B is pivotally mounted on the second post 210B. The shutter members 220A, 220B may be biased towards the center of the aperture (i.e., towards each other) via a biasing member 225 (e.g., a spring) that spans the members.

The first shutter member 220A includes a body 230A possessing a generally semicircular shape, having a straight edge portion 235A and a rounded edge portion 240A. The body 230A further includes a truncated area 245 along its proximal portion that is configured to frictionally mesh with a protruding area on the second shutter 220A. The second shutter member 220B includes a body 230B possessing a generally semicircular shape, defining a generally straight edge portion 235B and a generally rounded edge portion 240B. The rounded edge portions 240A, 240B of the shutter members 220A, 220B may possess a radius of curvature that corresponds to the radius of curvature of the side wall inner surface 247. With this configuration, the rounded edge portions 240A, 240B are contoured to their respective side wall area. Additionally, the interior surface 247 of the body 100 includes a recess 248 defining an annular shoulder on which the rearward plate rests 120.

The second shutter member 220B further includes a lever 250 extending radially from the body 230B. The base 252 of the lever 250 is configured to engage the truncated area 245 of the first shutter body 230A such that rotation of the second shutter member 220B causes an opposite rotation in the first shutter member 220A (explained in greater detail below). The distal portion of the lever 250 of the second shutter member 220B extends through an elongated slot 255 formed into side wall 105 of the housing 100. The slot 255 may define the travel length an operator may move the lever 250 during operation.

Figure 3A:
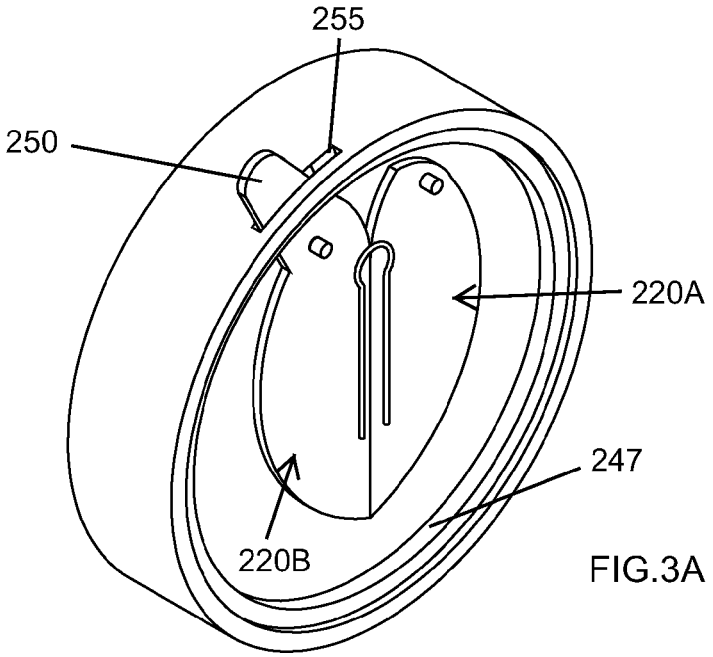
FIG. 3A and 3B illustrate rear perspective views of the security cover shown in FIG. 1A, with the eyecup and back panel removed to show the operation of the shutter mechanism.
Figure 3B:
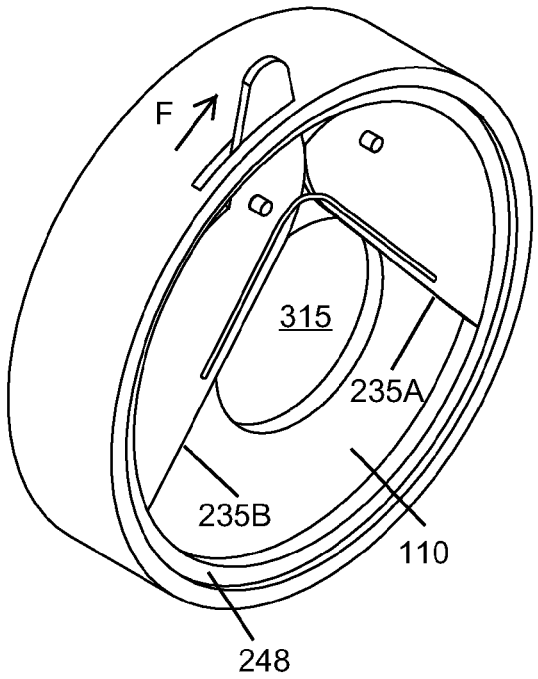

The operation of the security cover 10 is explained with reference to FIGS. 3A and 3B. The biasing member 225 biases the shutter members 220A, 220B in a normal or closed position, in which the straight edge portions 235A, 235B of the shutter members 220A, 220B contact each other. In this position, the body 230A, 230B of each shutter member 220A, 220B at least partially blocks the forward aperture 115. As such, a viewer positioned on the inside of the door cannot see through the cover 10. Similarly, a viewer positioned on the outside of the door cannot see light variations through the door viewer, and cannot view the area proximate the interior door surface. Should an inside viewer desire to look through the door viewer, the inside viewer engages the lever 250 (indicated by arrow F) to pivot to rotate the upper circle of the second shutter member 220B (i.e., the base 252) toward the upper circle of (i.e., truncated portion 245) the first shutter member 220A (e.g., in a clockwise direction from the perspective of FIG. 3B). Rotation of the second shutter member 220B causes the base 252 of the lever 250 to frictionally engage the truncated portion 245 of the first shutter member 220A; consequently, the clockwise rotation of the second shutter member 220B rotates the first shutter member 220A in counterclockwise direction. As a result, the shutter members 220A, 220B separate, moving from the normal, closed position (FIG. 3A) to an opened position (FIG. 3B). Since the outer rounded edges 240A, 240B of the shutter members 220A, 220B are contoured to the inner surface 247 of the side wall 105, the shutter members abut the side wall. With this configuration, in the opened position, the bodies 230A, 230B of the shutter members 220A, 220B clear the forward 115 and rearward 125 apertures enabling an inside viewer may see through the cover 10 and the door viewer device.

Thus, the present invention provides an inexpensive, easily operated device that can be attached to any conventional door including a door viewer. The cover 10 is biased in its closed position; consequently, an outside viewer (i.e., a viewer positioned along the front of the door) cannot look through the door viewer to see into the secured structure (e.g., house, apartment, etc.). In addition, the outside viewer cannot see any light variation that occurs as an inside viewer approaches the door viewer device. Should an inside viewer desire to look through the door viewer device, the inside viewer user simply places an eye against the eyecup 130, further shielding the door viewer device from light, and then engages the lever 250 to open the shutter mechanism as described above. The inside viewer may now view the outside viewer to confirm the outside viewer's identity. During the viewing process, the outside viewer remains unaware of the presence of the inside viewer since no light variation can be detected.

Figure 4:
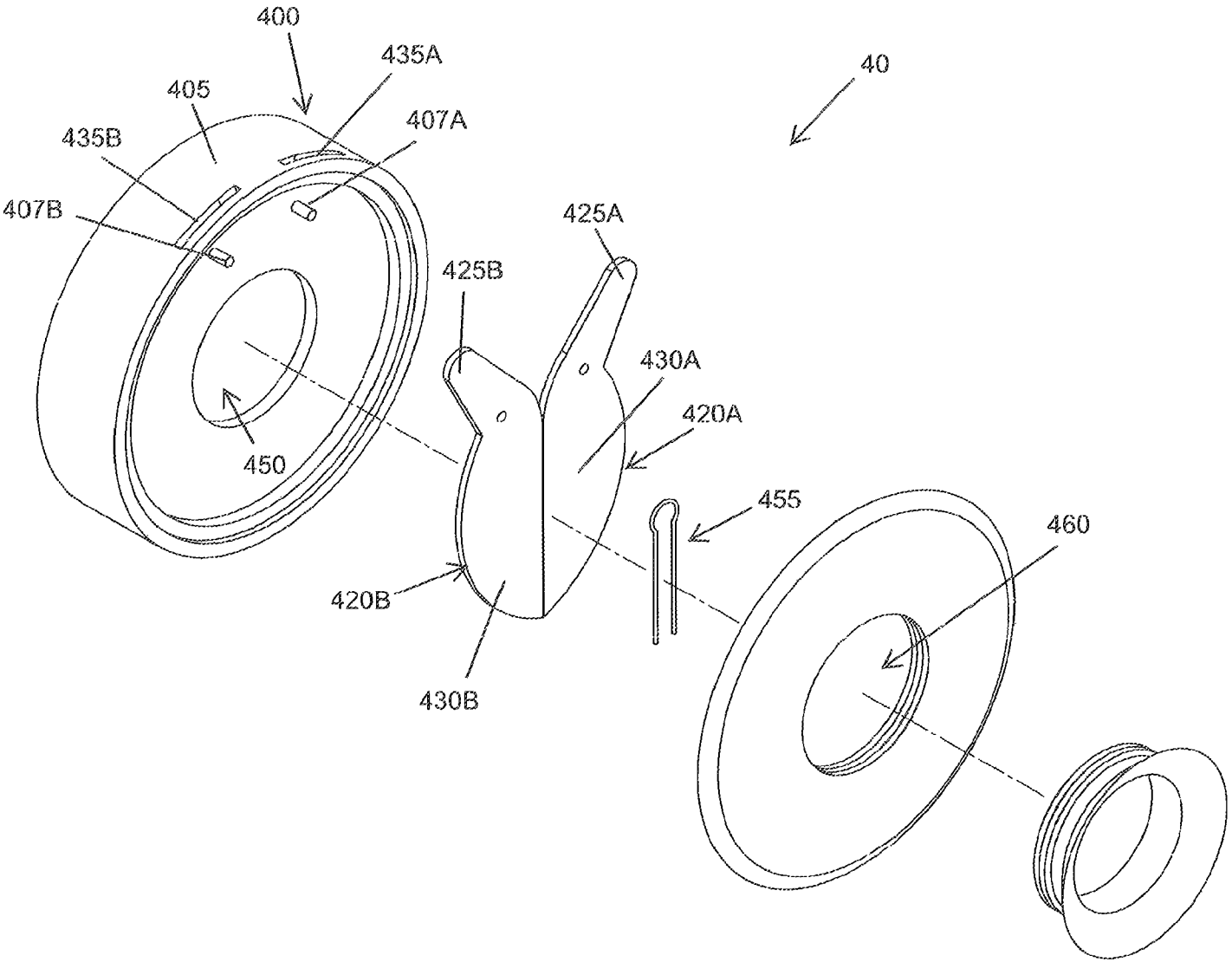
FIG. 4 illustrates an exploded view of a security cover in accordance with another aspect of the present invention.

FIG. 4 illustrates a security cover 40 for a door viewer device in accordance with another aspect of the invention. As shown, the cover 40 includes a structure similar to that described above, including a housing 400 with a side wall 405, and axially extending posts 407A, 407B disposed on the rear side 410 of a forward plate 415. This configuration further includes a first shutter member 420A including a first lever 425A and a first body 430A, as well as a second shutter member 420B including a second lever 425B and a second body 430B. That is, instead of the mechanism including a single lever that controls both shutter members, each shutter member 420A, 420B now includes a lever 425A, 425B extending radially from the body 430A, 430B. The shutter bodies 430A, 430B, moreover, may no longer be geared together. The housing 400 further includes a first slot 435A associated with the first lever 425A and a second slot 435B associated with the second lever 425B.

Figure 5A:
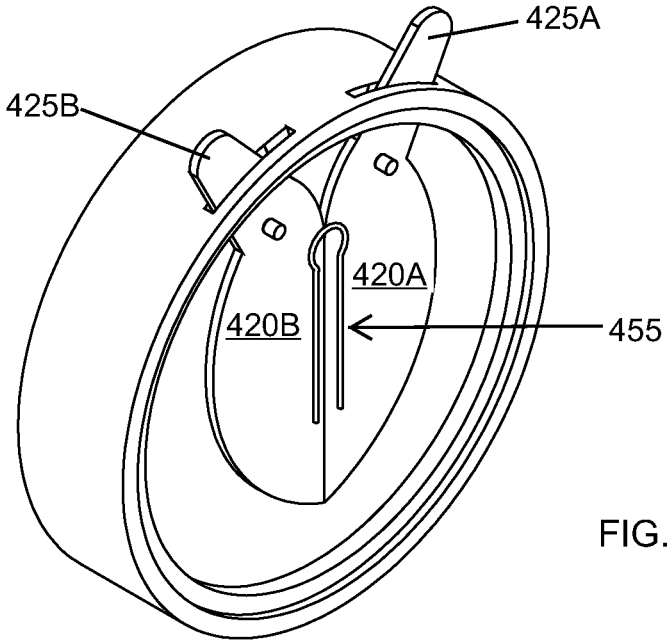
FIGS. 5A and 5B illustrate rear perspective views of the security cover shown in FIG. 4, with the eyecup and back panel removed to show the operation of the shutter mechanism.
Figure 5B:
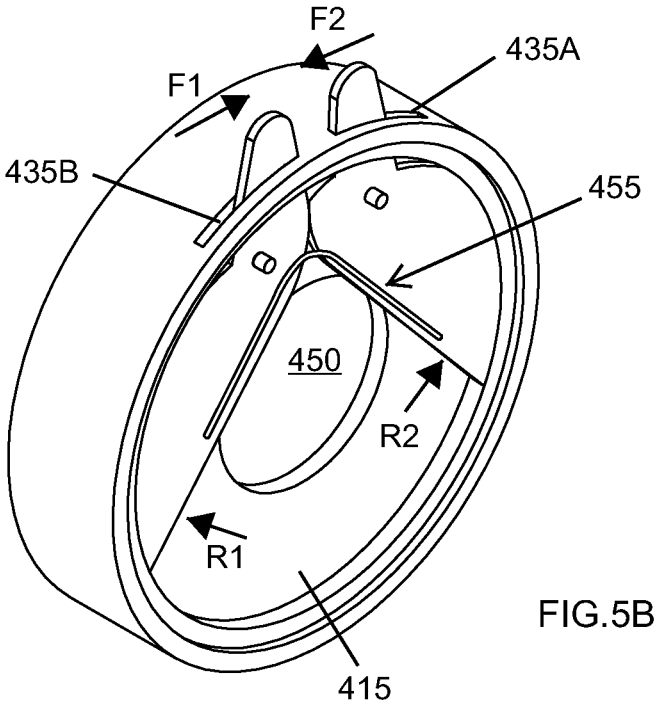

In operation, the shutter mechanism beings in its normal, closed position as shown in FIG. 5A. The inside viewer engages the levers 425A, 425B, driving them toward each other (e.g., the operator squeezes the levers together, indicated by F1 and F2). Each shutter member 420A, 420B pivots on its respective post 407A, 407B such that the first shutter member 420A rotates in one direction (e.g., a counterclockwise direction, indicated by R2) while the second shutter member 420B rotates in an opposite direction (e.g., a clockwise direction, indicated by R1). The shutter members 420A, 420B are rotated until the bodies 430A, 430B clear the forward 450 and rearward 460 apertures. Once clear of the forward aperture 450 clear the inside viewer may look though the security cover 10 and the door viewer device to investigate the area proximate the front of the door. Once the levers 405A, 405B are released, the biasing member 455 drives the shutter members 420A, 420B back to their normal (closed) position, in which each body 430A, 430B at least partially blocks the forward aperture 450.

Figure 6:
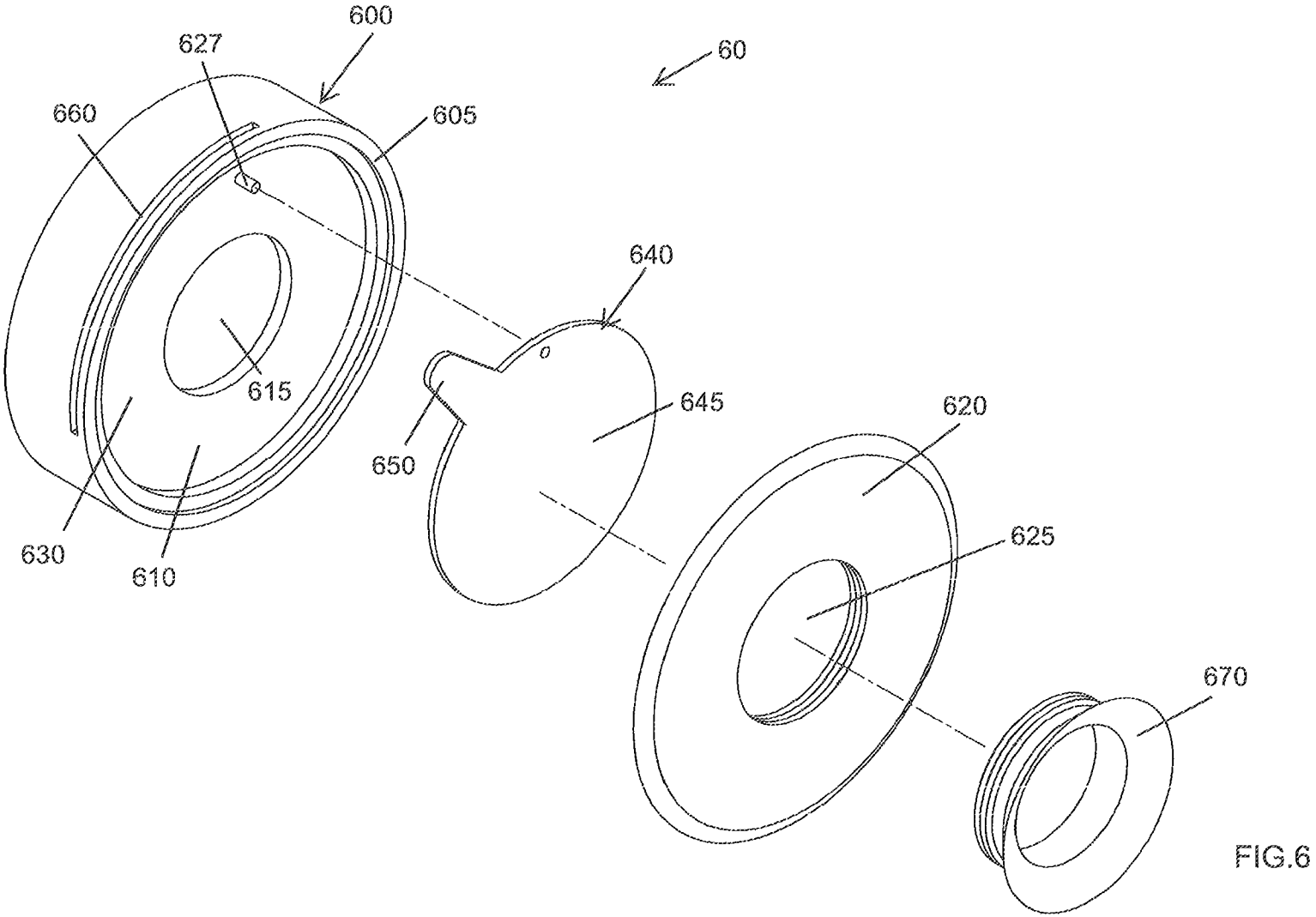
FIG. 6 illustrates an exploded view of the security cover in accordance with another aspect of the present invention.

FIG. 6 illustrates a security cover for a door viewer device in accordance with another aspect of the invention. As shown, the security cover 60 includes a housing 600, including a side wall 605 with a forward plate 610 defining a forward aperture 615, a rearward plate 620 defining a rearward or viewing aperture 625, and an axial post 627 extending distally from the rear side 630 of the forward plate 610. The cover 60 further includes a single shutter member 640 including a generally circular body 645 and a lever 650 extending radially therefrom. The side wall 605 of the housing 600 further includes a slot 660 that enables passage of the shutter member 640 therethrough. As with the other embodiments, the cover 60 further includes an eyecup 670 secured to the rearward plate 620.

Figure 7A:
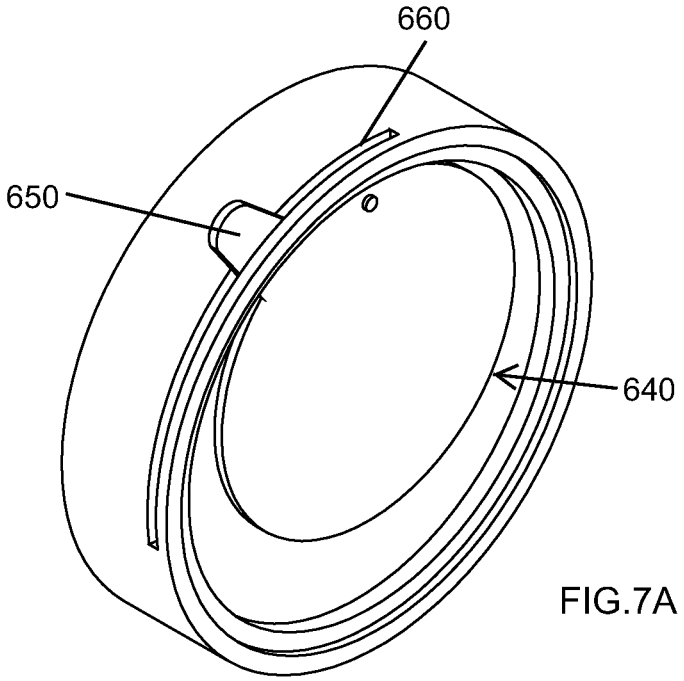
FIGS. 7A and 7B illustrate rear perspective views of the security cover shown in FIG. 6, with the eyecup and back panel removed to show the operation of the shutter mechanism.
Figure 7B:
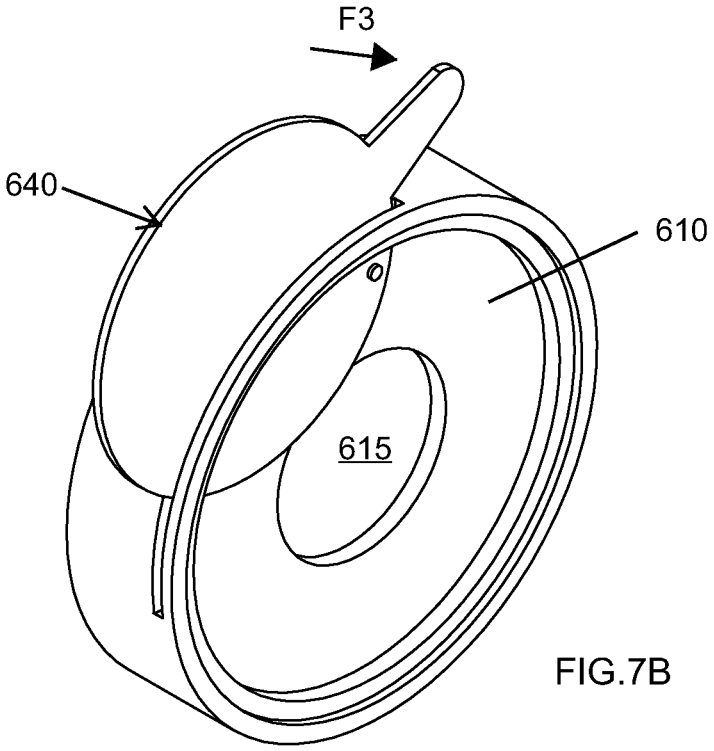

Operation of the device is explained with reference to FIGS. 7A and 7B. As shown, pivoting the lever 650 (indicated by F3) drives the body 645 of the shutter member 640 out of alignment with the viewing aperture 625, enabling an inside viewer to look through the door viewer device. Releasing the lever 650 returns the shutter member 640 to its normal closed position, via gravity.

Figure 8:
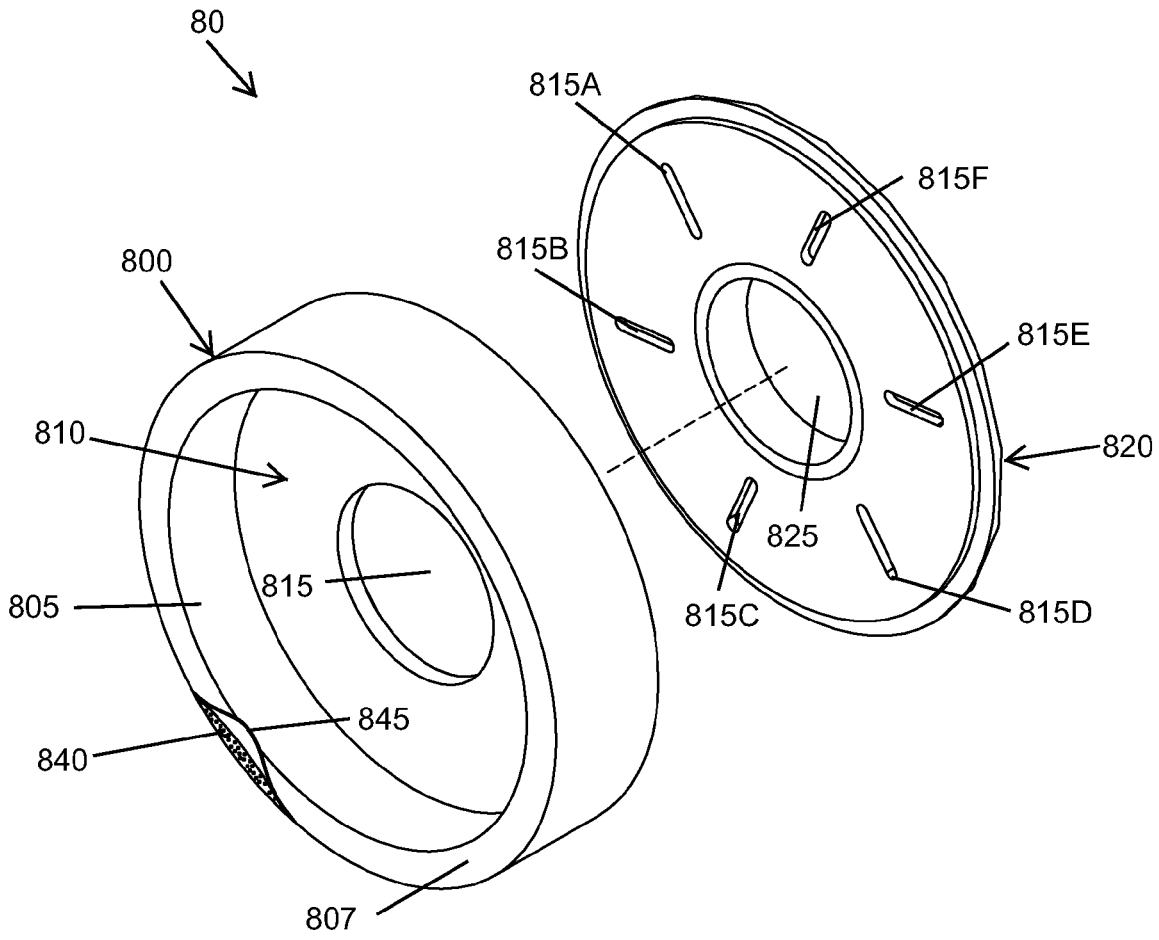
FIG. 8 illustrates an exploded view of a security cover in accordance with another aspect of the invention.

FIGS. 8-10 illustrate a security cover for a door viewer device in accordance with another aspect of the invention. As illustrated, the security cover 80 includes a housing 800 including a side wall 805 defining a rim 807, a forward annular plate 810 defining a forward aperture 815, and a rearward annular plate 820 defining a rearward or viewing aperture 825. As shown, the rim 807 is further coated with an adhesive 840, which, in turn, is covered with release paper 845.

Figure 9A:
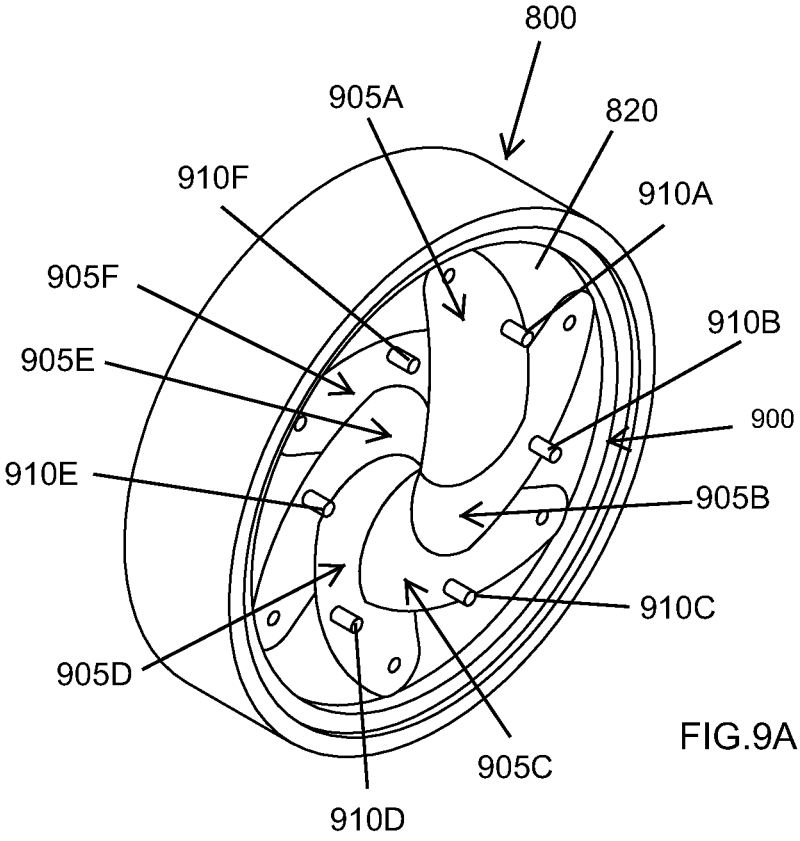
FIGS. 9A and 9B illustrate rear perspective views of a security cover in accordance with an aspect of the invention, with the eyecup and back panel removed to show the shutter mechanism in its closed and open positions, respectively.
Figure 9B:
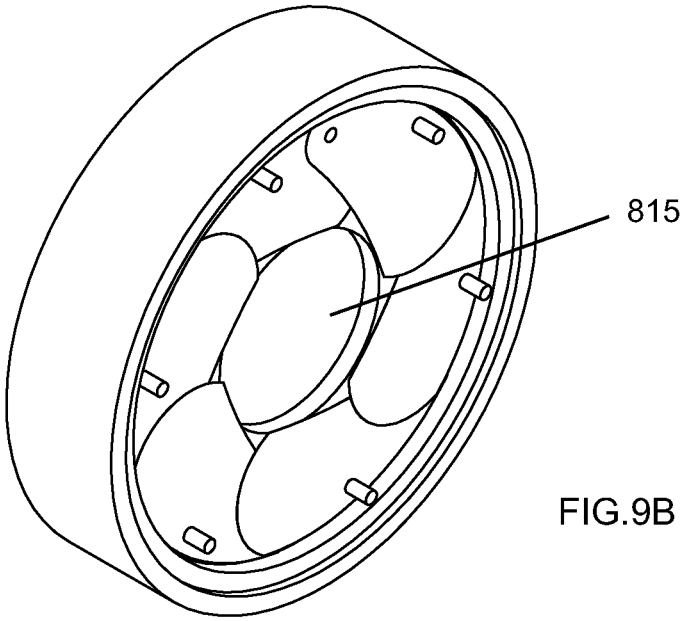

Referring to FIGS. 9A and 9B, the shutter mechanism is in the form of an optical diaphragm 900 including a plurality of blades 905A-905F pivotally coupled to the rear side of the forward plate 810 via a post extending from the forward plate rear side in a manner similar to that described above (posts not shown). Each blade 905A-905F possesses a generally teardrop shape including a narrow proximal end and a wide distal end. Each blade includes a follower pin 910A-910F disposed at an intermediate location along the blade, proximate blade outer edge. In addition, the rearward plate 820 further includes a plurality of radial slots 815A-815F angularly spaced about the plate. Each follower pin 910A-910F is captured within its respective slot 815A-815F, with the slot defining the travel path of each blade. It should be understood, however, that the diaphragm 900 may possess any number of blades. Additionally, each blade may possess any dimensions and shape (e.g., polygons, etc.) suitable for its described purpose.

Figure 10A:
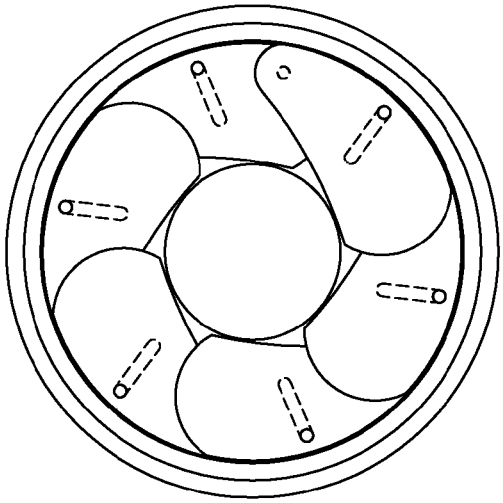
FIGS. 10A, 10B, and 10C illustrate rear plan views of the device of FIG. 9A, showing the operation of the shutter mechanism.
Figure 10B:
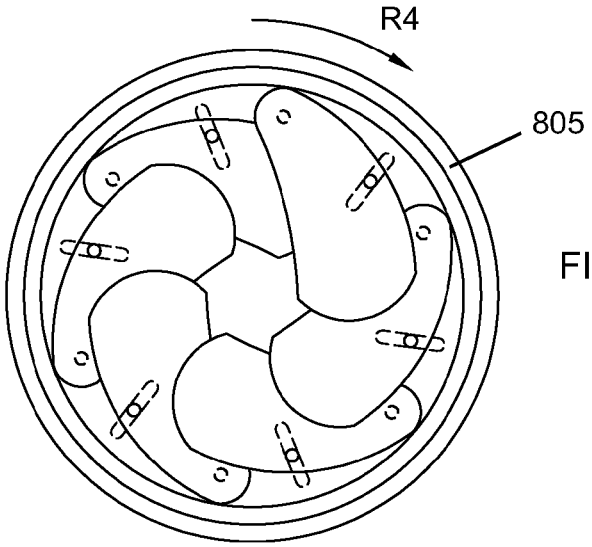
Figure 10C:
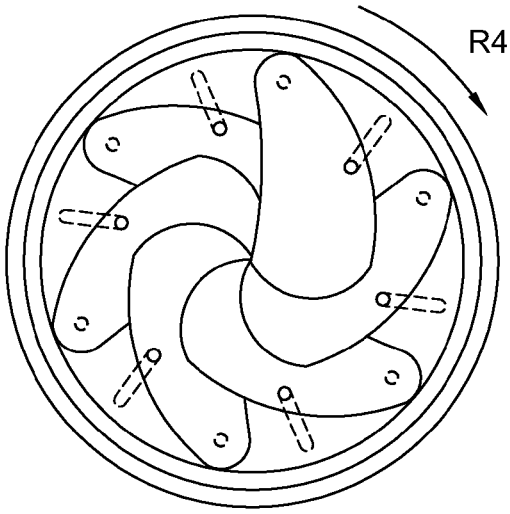

Referring to FIGS. 10A-10C, with this configuration, rotation of the rearward plate 820 (indicated by arrow R4) causes each follower pin 910A-910F to moves along its respective slot 815A-815F, pivoting each blade 905A-905F radially, rotating it from an opened position, in which each blade clears the forward aperture 815 (FIG. 10A), to a closed position (FIG. 10C), in which each blade at least partially blocks the forward aperture (FIG. 10C). That is, the wider end of the blade, defining the distal blade end, at least partially covers the forward aperture 815 in the closed position. To close the shutter mechanism, the rearward plate 820 is rotated in the reverse direction.

Figure 11:
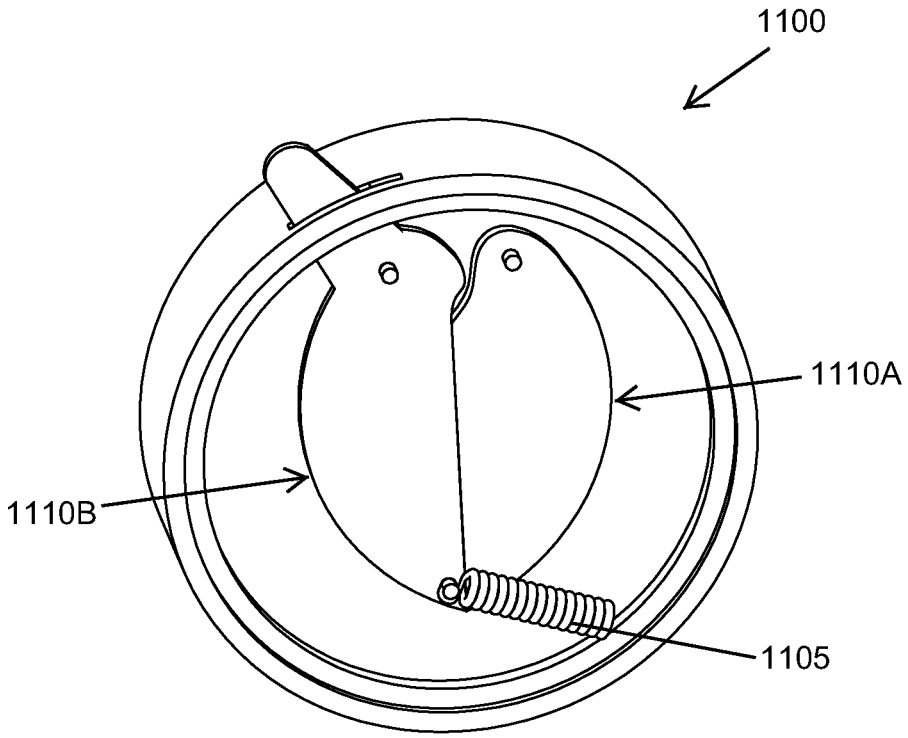
FIG. 11 illustrates a security cover for a door viewer in accordance with an aspect of the invention.
Figure 12A:
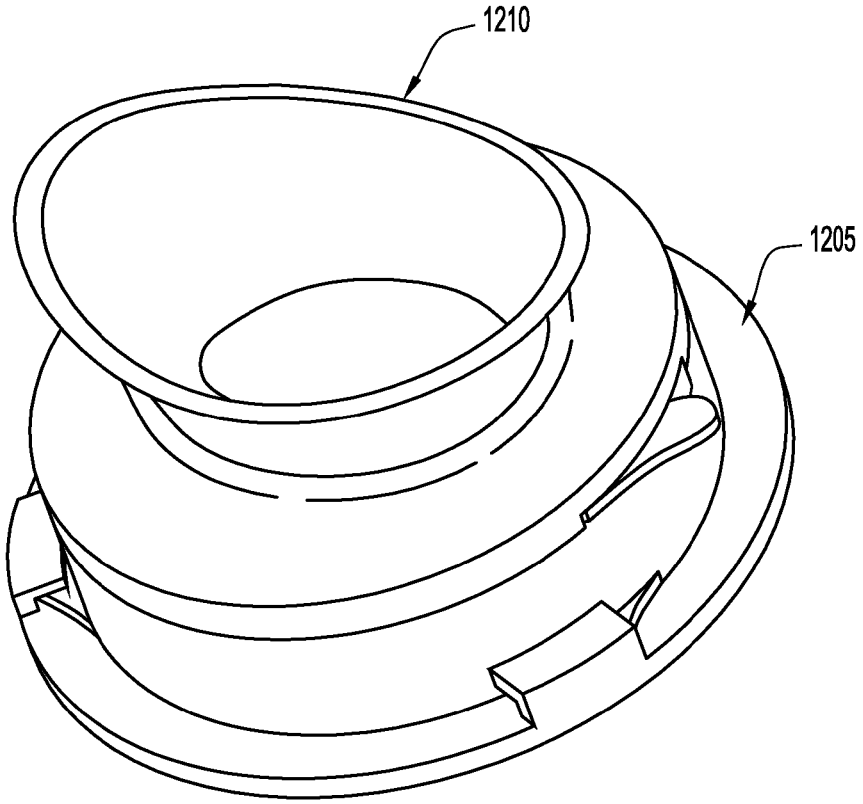
FIG. 12A illustrates a security cover for a door viewer in accordance with an aspect of the invention.
Figure 12B:
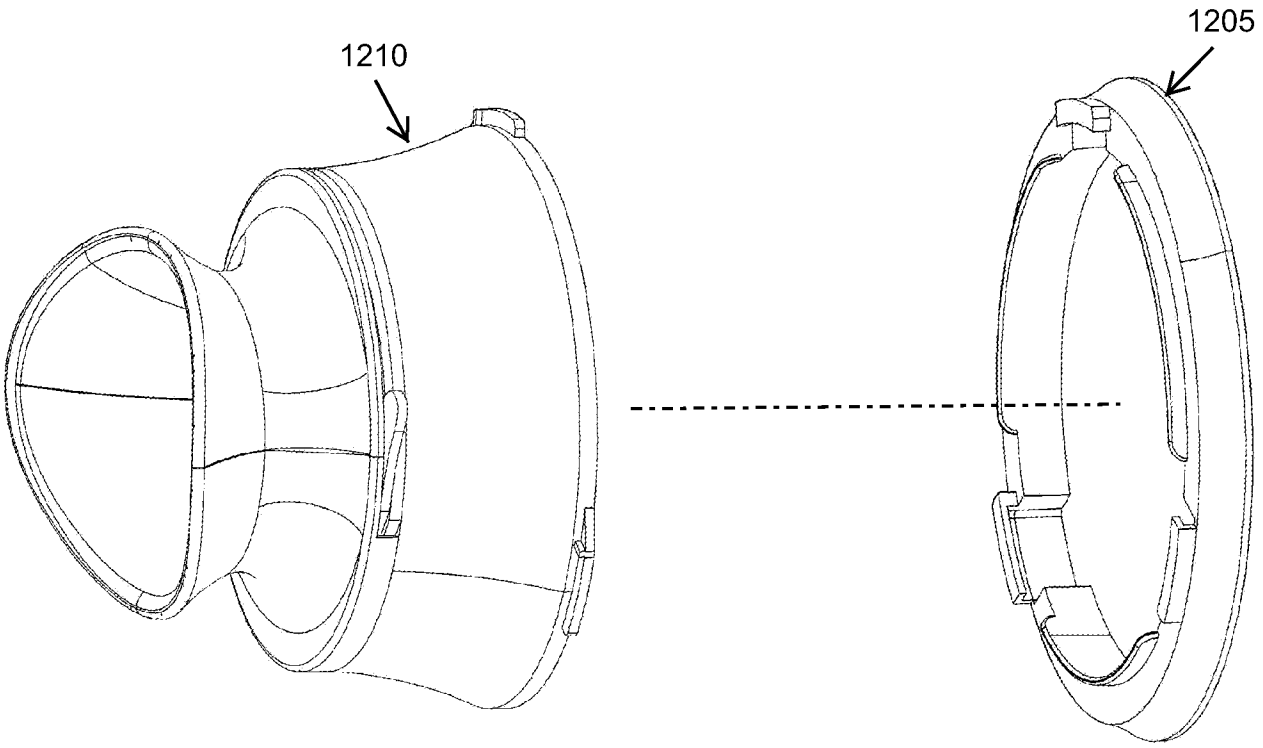
FIG. 12B illustrates an exploded view of the security cover shown in FIG. 12A.

FIG. 11 illustrates a security cover for a door viewer device in accordance with an aspect of the invention. As shown, the security cover 1100 includes a structure similar to that described above in FIGS. 1A and 1B. In this configuration, however, the biasing member 1105 is a coil spring coupled to the distal end of the second shutter member 1110B. As with the embodiment described above regarding FIG. 1A, movement of the second shutter member 1110B generates a corresponding movement in the first shutter member 1110A.

FIGS. 12-18 illustrate a security cover for a door viewer in accordance with another aspect of the invention. Referring to FIGS. 12A and 12B, the cover assembly 1200 includes a base or coupling member 1205 and a shutter assembly 1210 coupled to the base member. The base member 1205 is configured to couple the shutter assembly 1210 to the area of the door containing the door viewer. Referring to FIGS. 13A-13D, the base member 1205 includes a body 1305 defining a first or door-facing end or side 1310A and a second or shutter-facing end or side 1310B. The body 1305 may be generally annular, including a central opening or aperture 1312 defined by an inner wall 1315. The body 1305 may taper in the direction of the shutter-facing side 1310B, i.e., the outer diameter of the body may be wider along its door-facing side 1310A and a narrower shutter-facing side 1310B. Stated another way, the body 1305 may be generally frustoconical. Accordingly, the diameter of the opening 1312 along the door-facing side 1310A may be greater than the diameter of the opening 1312 along the shutter-facing side 1310B.

The base member 1205 further includes one or more axial guide walls extending distally from the shutter-facing surface 1310B of the body 1305. In the embodiment illustrated, the base member 1205 includes three axial guide walls 1320A, 1320B, 1320C angularly spaced about the body 1305 along the body inner perimeter 1322 (e.g., the walls 1320A-1320C may be equidistantly spaced). Each guide wall 1320A-1320C may span a predetermined angular extent along the body. By way of example, the first guide wall may extend approximately 25°-35° along the inner perimeter of the body 1305 defined by the inner wall 1315, while the second guide wall 1320A and the third guide wall 1320C may each extend approximately 45-55° along the inner perimeter of the body defined by the inner wall 1315. It should be understood that the guide walls 1320A-1320C may possess any dimensions (height, width, length) and shape suitable for their described purpose. Additionally, the body 1305 may contain any number of guide walls. In operation, the guide walls 1320A-1320C engage the interior surface of the shutter member housing to maintain the shutter assembly in position during coupling to the base member.

The surface of the door-facing side 1310A of the base member 1205 may be modified such that the base member attaches to the door surface. By way of example, the door-facing surface may be coated with a layer of adhesive (e.g., pressure sensitive adhesive), optionally covered with release paper. Alternatively, the body 1305 may be modified to permit the use of fasteners (e.g., including fastener (screw) channels through which a fastener passes).

Figure 13A:
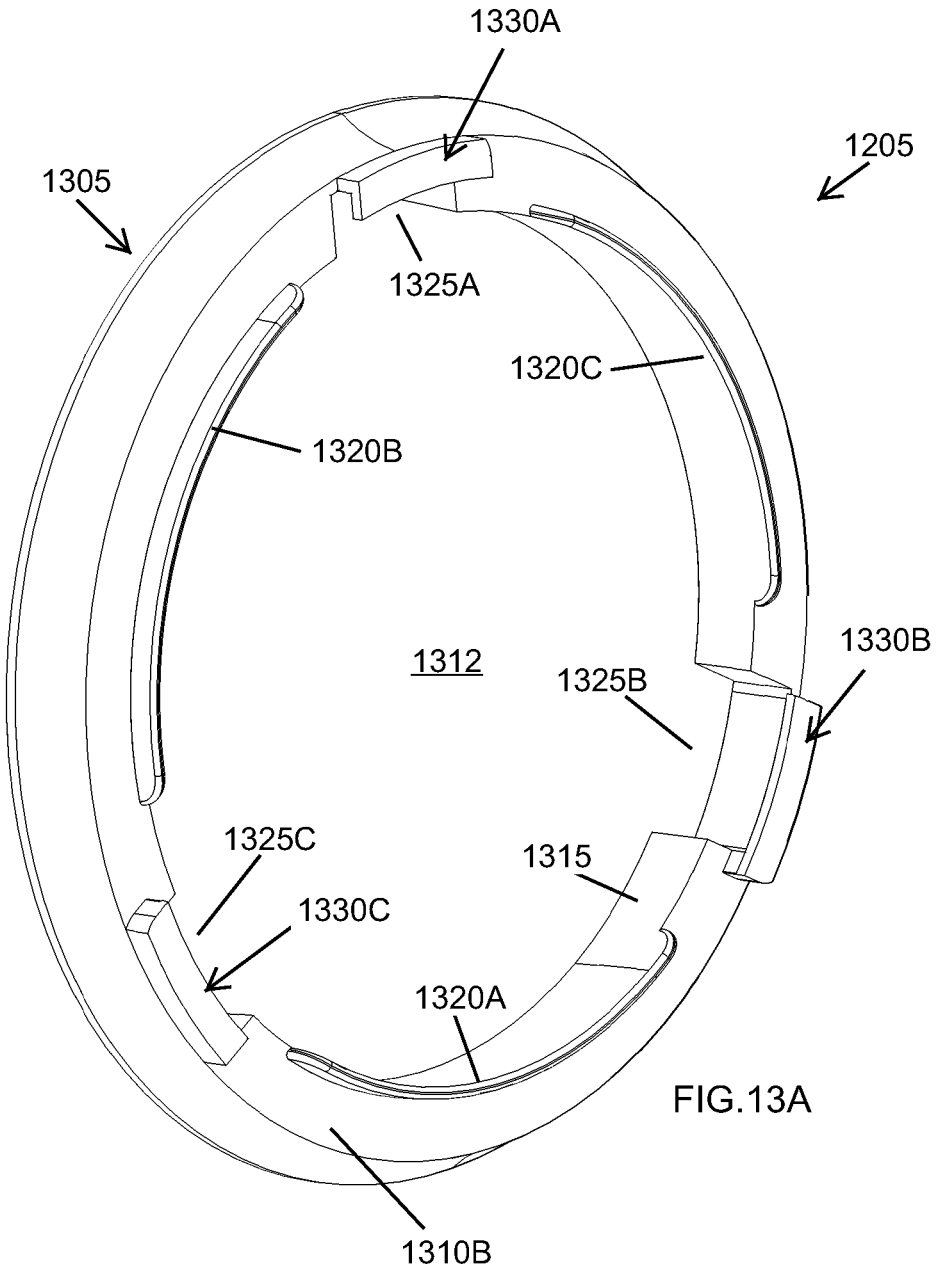
FIGS. 13A-13D illustrate the base member of the security cover shown in FIG. 12A.
Figure 13B:
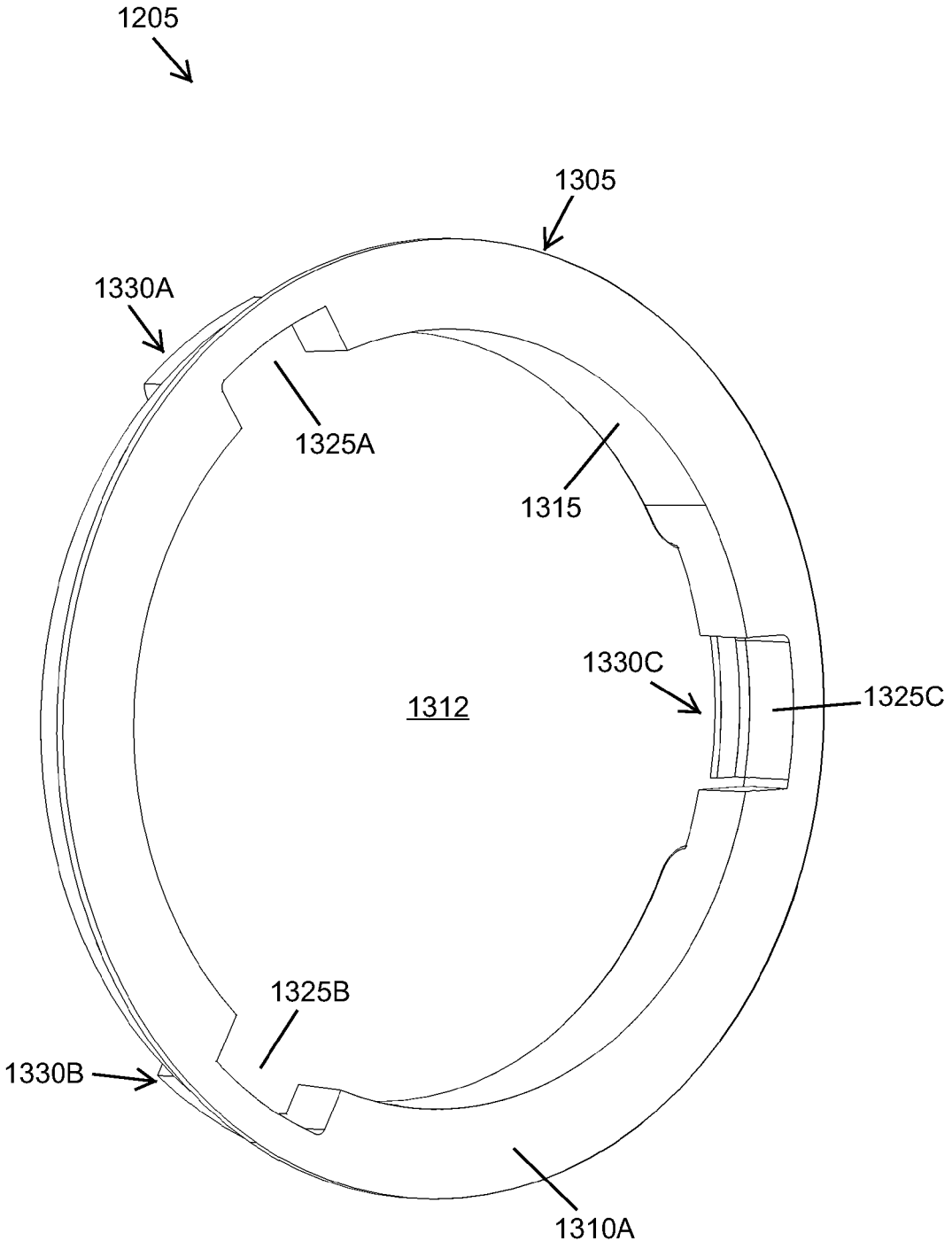
Figure 13C:
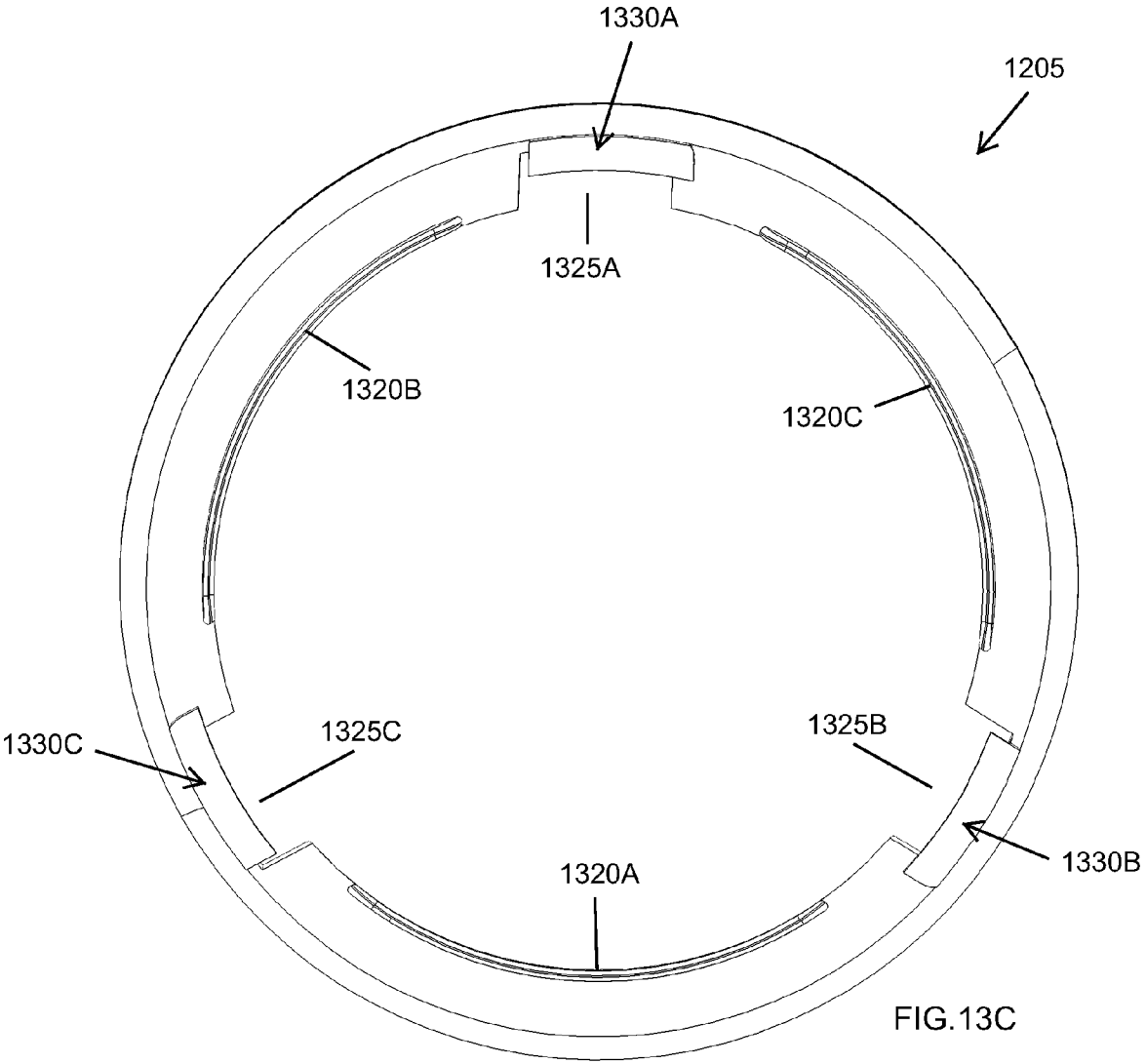
Figure 13D:
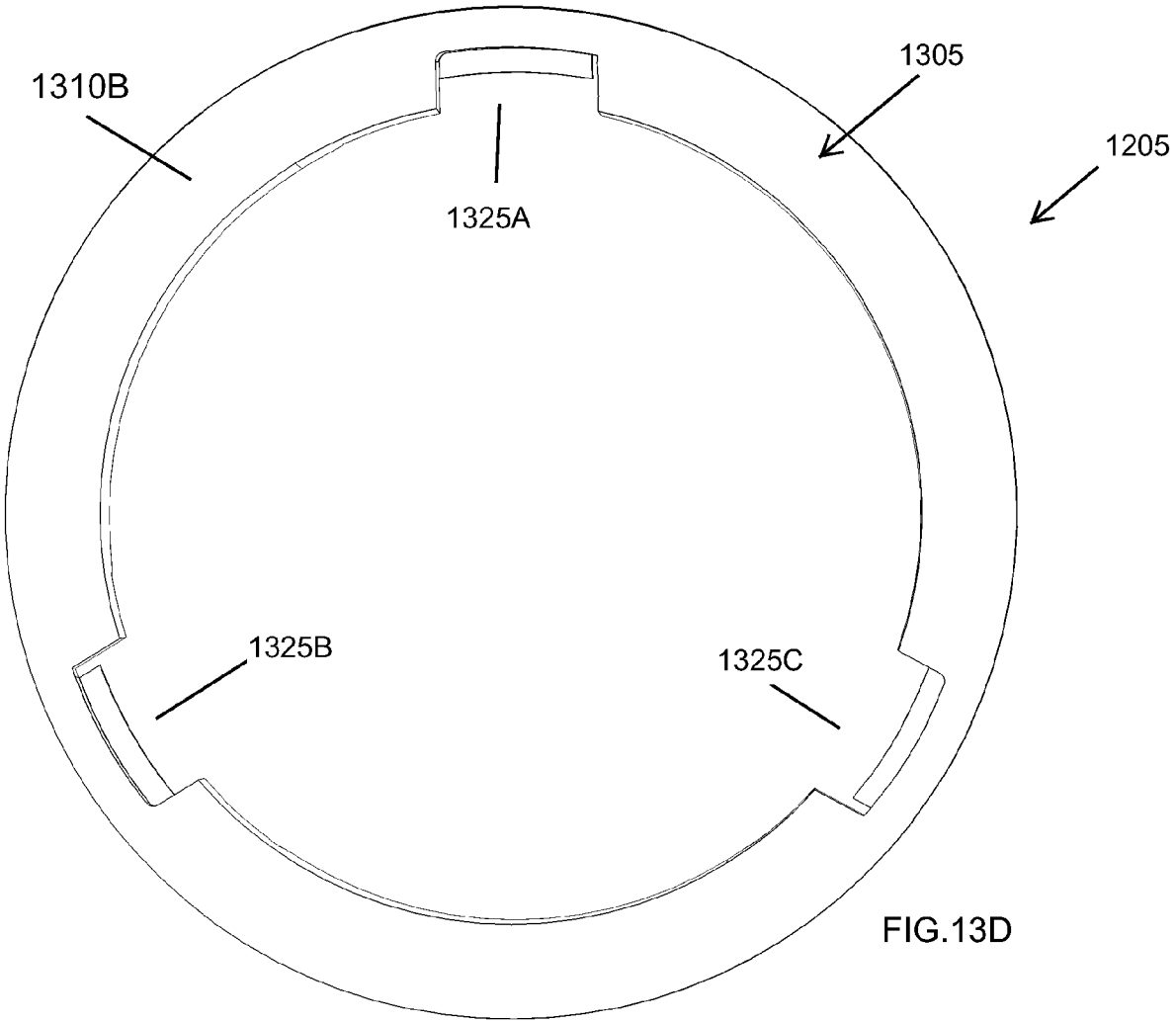

The base member 1205 further includes a connection mechanism operable to mate with a corresponding connection mechanism on the shutter assembly 1210, coupling the shutter assembly to the base member. For example, the base member 1205 may include one or more axial notches and/or hooks adapted to capture corresponding elements on the shutter housing. Referring to FIG. 13A, the base member 1205 includes a plurality axial notches extending axially through the body 1305 at predetermined angular locations. In the illustrated embodiment, the connection mechanism includes three axial notches 1325A, 1325B, 1325C angularly spaced about the body 1305, each being disposed between adjacent axial walls 1320A-1320C. The shape and dimensions of the notches 1325A-1325C may be any suitable for its described purpose. In the illustrated embodiment, the notches 1325A-1325C are polygonal, extending radially into the body 1305.

Figure 14:
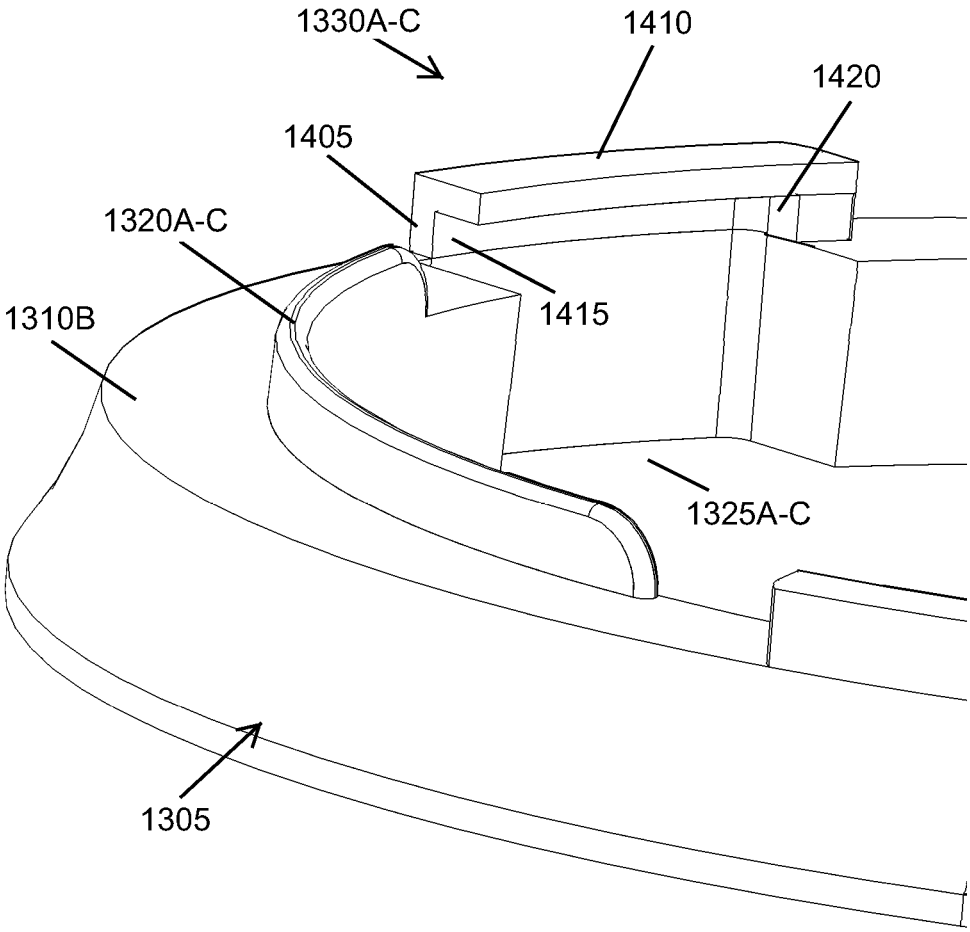
FIG. 14 illustrates a close-up of a hook on the base member shown in FIG. 13A.

The connection mechanism may further include one or more hooks operable to engage corresponding locking tabs disposed on the shutter assembly. In the illustrated embodiment, the connection mechanism includes three hooks 1330A, 1330B, 1330C each associated with a corresponding notch 1325A-1325C. Each hook 1330A-1330C extends axially from the shutter facing side 1310B of the body 1305, generally aligning radially with an associated notch 1320A-1320C. Referring to FIG. 14, each hook 1330A-1330C is generally L-shaped, including an axial arm portion 1405 extending distally from the base member body 1305 and a radial arm portion 1410 extending radially inward from the distal end of the axial arm portion such that the radial arm portion extends over at least a portion of the notch opening 1325A-1325C. The hook 1330A-1330C further includes an open lateral end 1415 and a closed lateral end 1420 (created by a lateral side wall). With this configuration, the hook 1330A-1330C defines an opened slot configured to receive the locking tab disposed on the shutter assembly 1210 via the open lateral end 1415 defined by the hook. The closed lateral end 1420 serves as a stop, preventing rotation of the locking tab within the hook (and thus the rotation of the shutter assembly) beyond the closed lateral end. That is, once the locking tab of the shutter assembly 1210 is positioned within the hooks 1330A-1330C, the locking tabs is seated, with the hooks capturing the shutter assembly to the base member 1205.

Referring to FIGS. 15A-15E, the shutter assembly 1210 includes a shutter portion 1505 and an eyecup portion 1510 coupled (e.g., mounted) thereto. The shutter portion 1505 includes a housing 1515 defining a first or forward side or end 1520A that couples to the base member 1205 and a second or rearward side or end 1520B that couples to the eyecup 1510. The housing 1515 may be generally annular, with an interior surface 1522 of the housing defining an opening or channel 1525. The housing 1515 may taper in the rearward direction such that the diameter of the channel 1525 along the forward side 1520A is greater than the diameter of the channel 1525 along the rearward side 1520B (e.g., the housing may be generally frustoconical). The housing 1515 further includes an elongated slot 1527 disposed along the housing rearward side 1520B and generally aligned with a shutter mechanism disposed within the housing (discussed in greater detail below).

Figure 15A:
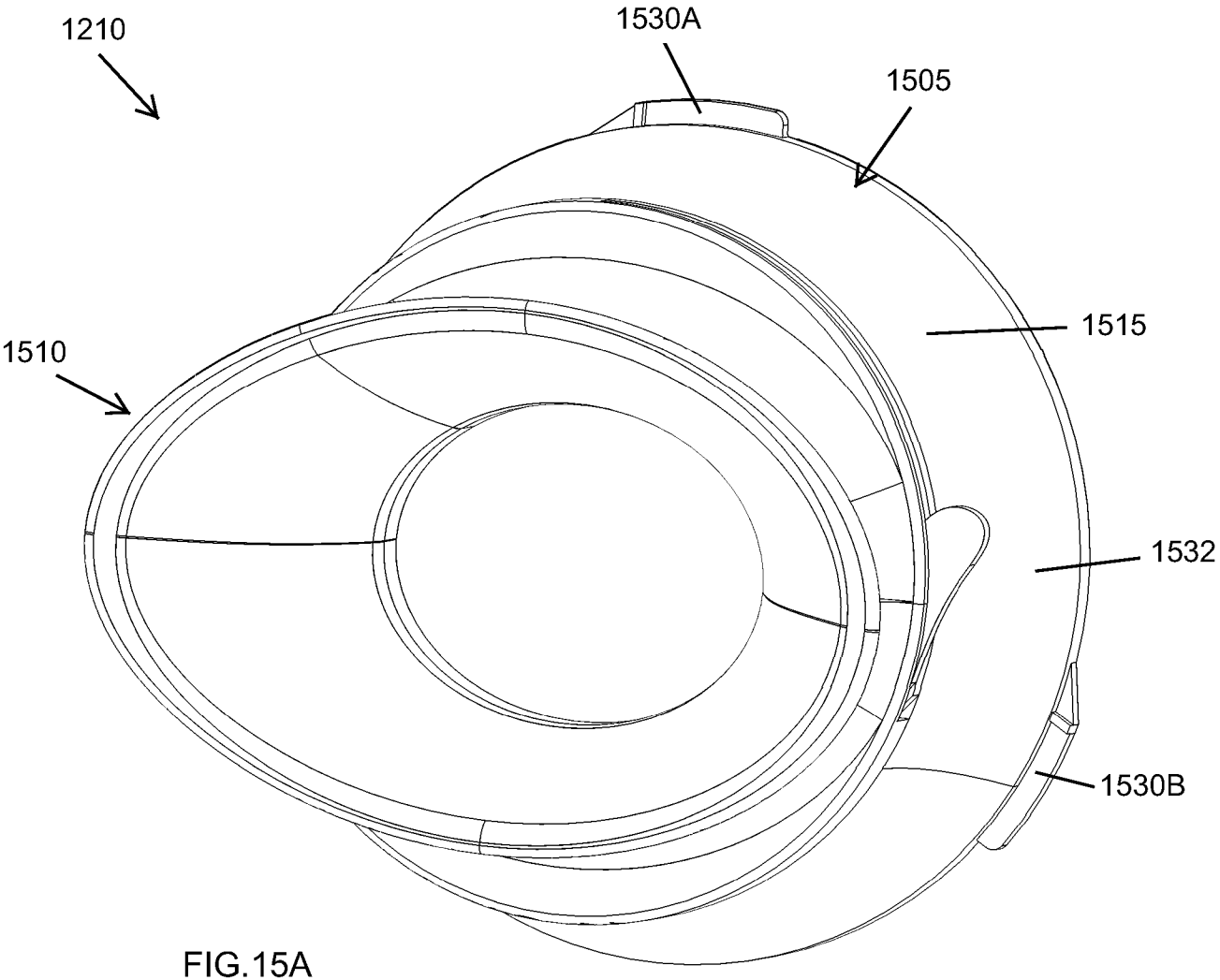
FIGS. 15A-15F illustrate the shutter assembly of the security cover shown in FIG. 12A.
Figure 15B:
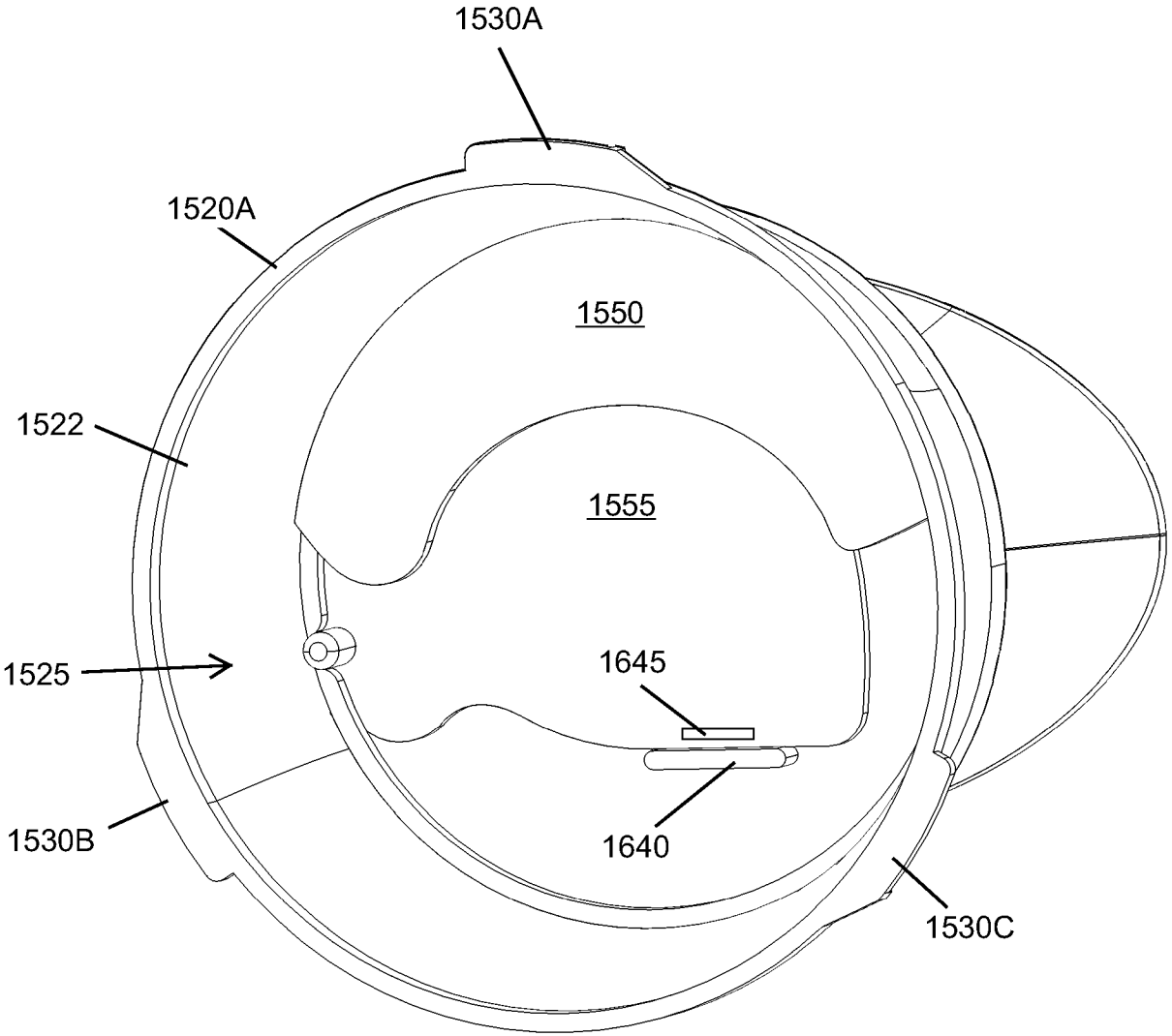
Figure 15C:
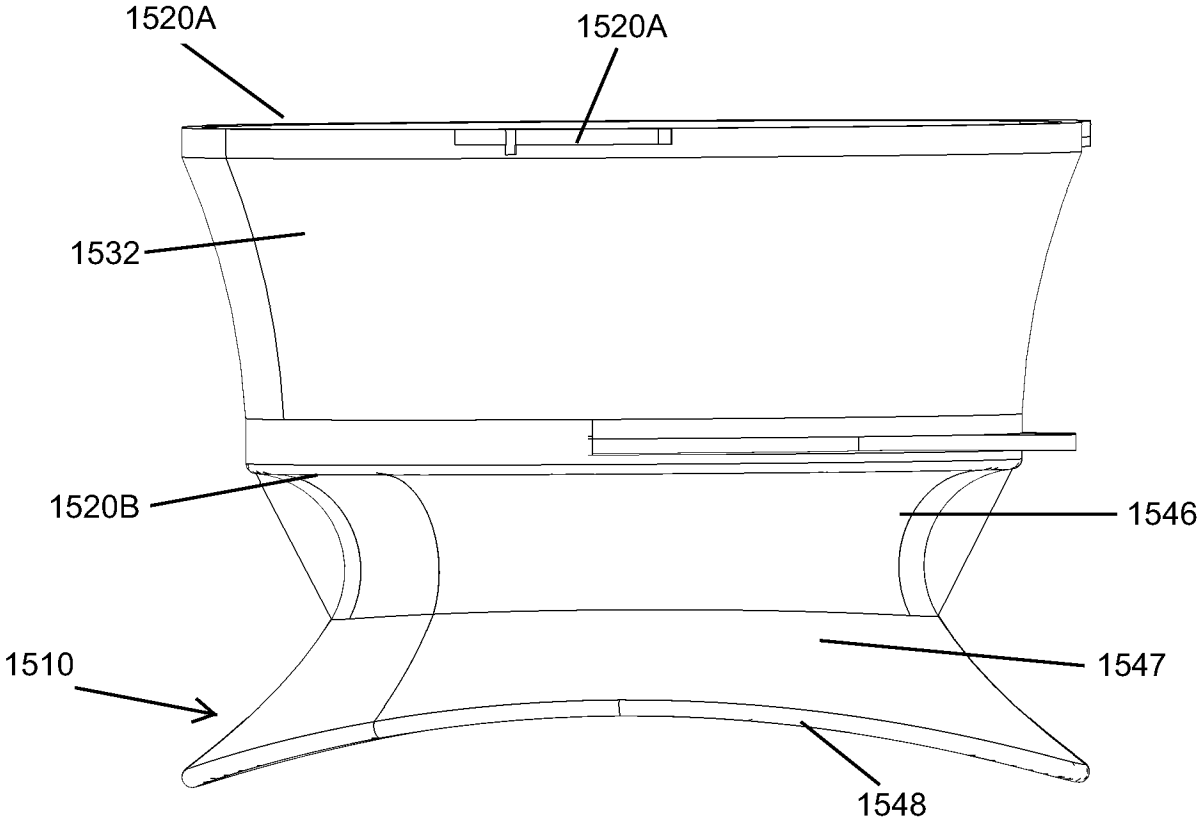
Figure 15D:
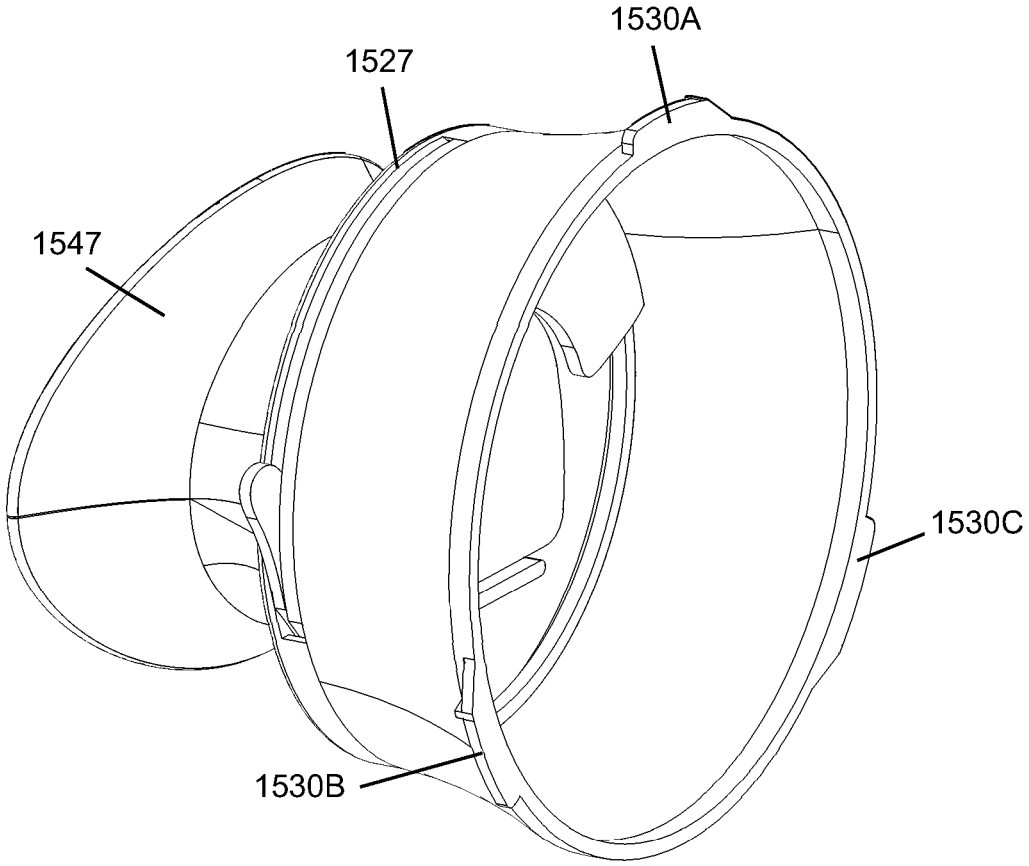
Figure 15E:
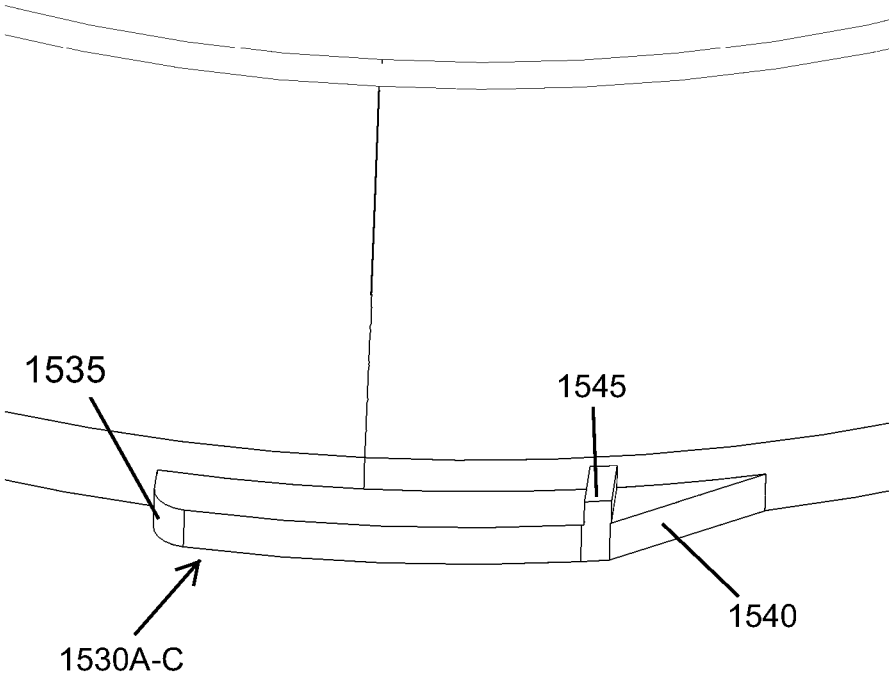
Figure 15F:
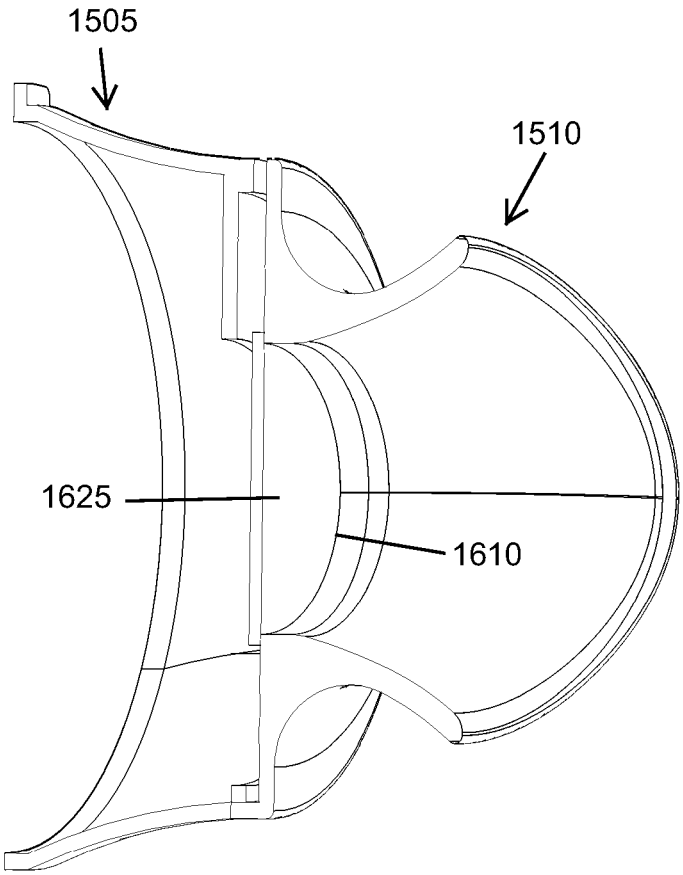

As mentioned above, a plurality of locking elements or tabs, configured to mate with the hooks 1330A-1330D on the base member 1205, may be disposed at desired angular locations about the body outer surface 1532. In the illustrated embodiment, the housing 1515 includes three locking tabs 1530A, 1530B, 1530C, each extending radially from the body outer surface 1532 proximate the forward end 1520A of the housing 1515, the tabs being angularly spaced to align with a corresponding hooks 1330A-1330C on the base member 1205. Referring to FIG. 15E, each locking tab 1530A-1530C includes a generally horizontal member including a leading edge portion 1535 and an angled or ramped edge portion 1540. The locking tab 1530A, 1530B, 1530C further includes a generally vertical member 1545 disposed proximate the ramped edge portion 1540. In operation, the leading edge portion 1535 enters the slot formed by the hook 1330A-1330C during coupling of the shutter assembly 1210 to the base member 1205. This, in turn, enables the shutter assembly to be selectively coupled to the base member (discussed in greater detail below).

Figure 16:
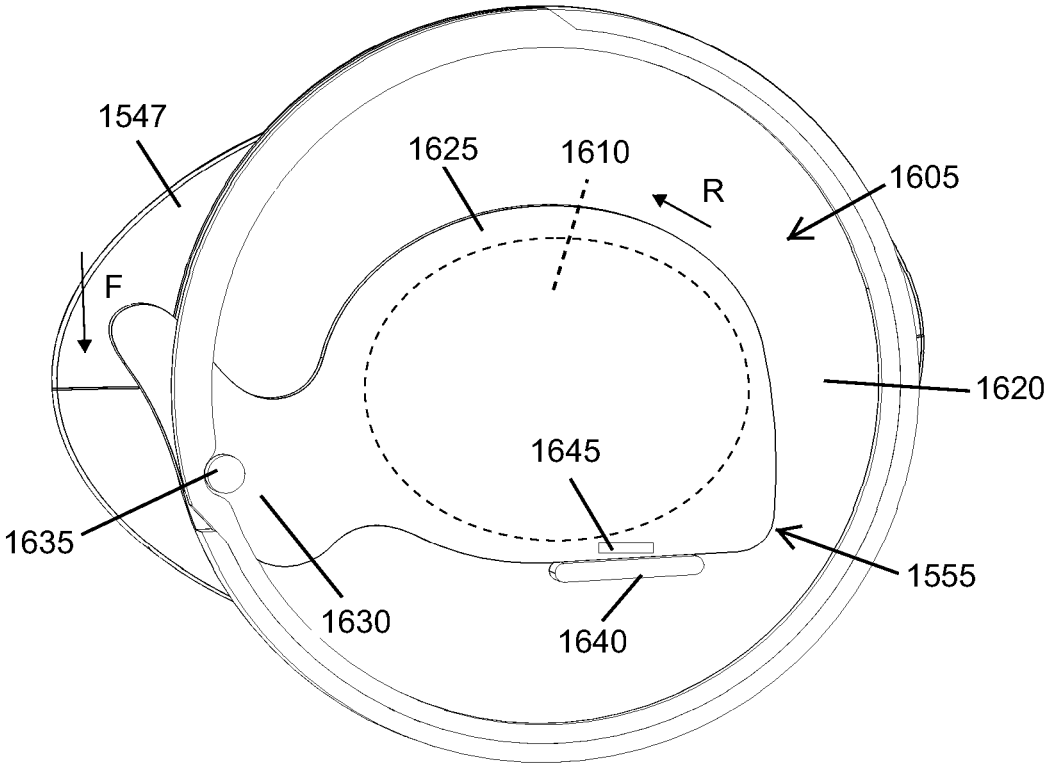
FIG. 16 illustrates a rear plan view of the device of FIG. 12A.

The eyecup portion 1510 is configured operable to shield out ambient light. In an embodiment, the eyecup portion 1510 includes an eyecup with a base section 1546 connected to the rearward end 1520B of the housing 1515 and a rim section 1547 extending rearward from the base section. The base section 1546 may be generally frustoconical. The eyecup 1547 may be a solid wall formed of light-blocking material that surrounds the aperture 1610 (FIG. 16). By way of example, the eyecup may be formed of rigid plastic or may be formed of flexible material (elastomers, rubber, etc.). As shown, the eyecup may be generally concave, initially curving inward, then curving outward along its rearward (user facing) end 1548. The rearward end 1548 of the rim section 1547 may contoured to snugly engage the orbit of the eye. With this configuration, placing the eye against the rim section 1547 permits the eyecup to enclose the eye, preventing the travel of light therethrough.

Referring to FIG. 16, a wall 1605 is disposed within the housing 1515 proximate housing rearward side 1520B. The wall 1605 includes an aperture 1610 possessing a diameter less than the diameter of the housing channel 1525. As illustrated, the aperture 1610 may possess a generally oval shape. The shutter assembly 1210 houses a shutter mechanism operable to control the amount of light passing through the housing 1515 by selectively covering the aperture 1610. Referring to FIG. 15B, the shutter mechanism includes a fixed shield 1550 and a repositionable shield or diaphragm 1555. The fixed shield 1550 may be a generally semi-annular (i.e., C-shaped) planar member extending radially inward from the interior surface 1522 of the housing 1515. The fixed shield 1550, moreover, extends angularly about a limited portion of the interior channel 1525 of the body. By way of example, the fixed shield may extend about 90° about the shutter channel 1525. With this configuration, the fixed shield may partially block the interior channel 1610. In operation, the fixed shield 1550 functions as a support for the repositionable shield 1555, supporting the repositionable shield in its closed position and guiding the repositionable shield as it moves from its closed position to its opened position.

The repositionable shield 1555, which cooperates with the fixed shield to permit selectively viewing through the lens of the peephole, includes a cover and an actuator in communication with the cover such that engaging the actuator reorients the cover respect to the housing 1515 (and thus the aperture 1610). In the embodiment illustrated in FIG. 16, the repositionable shield 1555 includes a generally semicircular cover or disc portion 1625 and an actuator arm or lever portion 1630 extending outward from the upper area of the cover portion. The disc portion 1625, which may be generally planar, possesses dimensions larger than those of the aperture 1610; consequently, when aligned with the aperture, the disc portion substantially or completely covers the aperture to prevent the passage of light through the housing 1515. The repositionable shield 1555 is pivotally coupled to the housing wall 1605 via a pivot post 1635 extending axially (along the housing or channel axis) from the forward (base-facing) surface of the wall and disposed at an intermediate location along the actuator arm 1630. The disc 1625 possesses a thickness that is slightly less than the width of the slot 1527 formed into the housing 1515. Accordingly, as the disc 1625 travels through the slot, it substantially blocks light, preventing light from entering the housing 1515 via the slot 1527.

A first stop member or rib 1640 extends from the forward surface 1620 of the housing wall 1605. The first stop member engages the disc 1625, preventing its rotation in a first direction (e.g., clockwise from the viewpoint of FIG. 16) beyond a predetermined angular position. By way of example, the stop member prevents over rotation of the disc 1625 when rotated to its closed position, thereby ensuring the disc blocks the aperture in its closed position). Additionally, the disc 1625 may include a second stop member 1645 extending from its forward side. The second stop member 1645 is configured to prevent over rotation of the disc in a second direction (e.g., counterclockwise from the viewpoint of FIG. 16). By way of example, the second stop member 1645 engages the interior surface 1522 of the housing 1515 proximate the slot 1527 to prevent the disc from completely passing through the slot and out of the housing. As illustrated, the stop members 1640, 1645 may be in the form of a generally elongated boss.

With this configuration, applying a downward force to the actuator 1630 (indicated by arrow F) rotates the disc 1625 (indicated by arrow R) out of alignment with the aperture 1610, permitting the passage of light through the shutter assembly 1210 and allowing a viewer to see through the security cover 1200. The user may rotate the disc until the second stop member 1645 engages the housing 1515. The repositionable shield 1555 configuration is eccentrically weighted such that simply releasing the actuator 1630 permits gravity to rotate the disc 1625 back to its closed position, in which it is aligned with the aperture 1610. Alternatively, applying an opposite (upward) force rotates the disc 1625 (clockwise from the viewpoint of FIG. 16) until the disc engages the first stop member 1640, positioning the repositionable shield 1555 back to its normal, closed position. It should be understood that while the shutter assembly is illustrated as a unitary (one-piece) structure, in other embodiments, the disc portion 1625 and the actuator portion 1630 may be separate components in communication with each other.

With the above configuration, the fixed shield 1550 and the repositionable shield 1555 cooperate to function as an aperture stop that controls the field of view of through the shutter assembly 1210. In a sense, the shutter mechanism functions as a field stop, being repositionable to selectively block the aperture 1610 of the housing 1515 and, consequently, to prevent the passage of light therethrough (i.e., the shutter mechanism blocks the view of a user looking through the shutter assembly via the eyecup 1510).

Figure 17A:
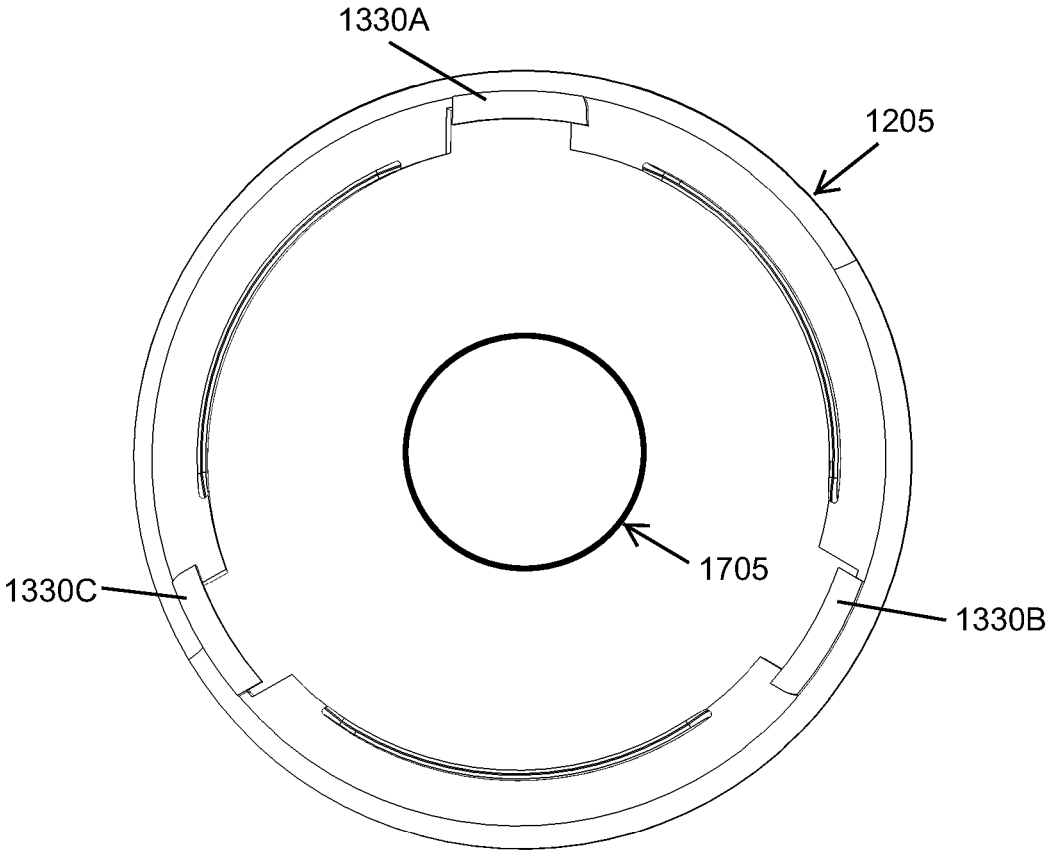
FIGS. 17A-17C illustrate the operation of the security cover shown in FIG. 12A.
Figure 17B:
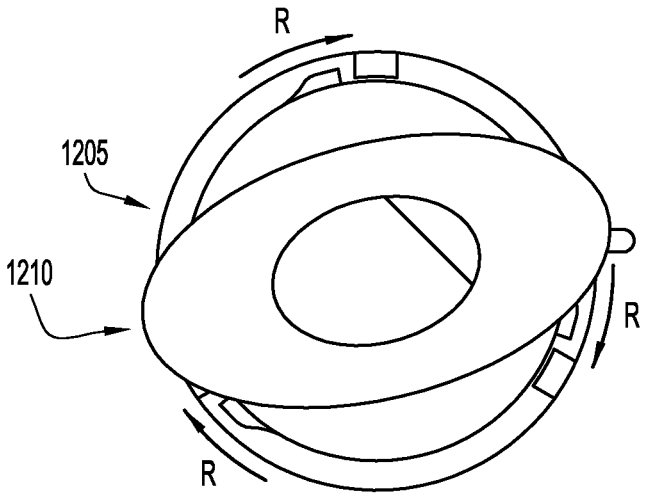
Figure 17C:
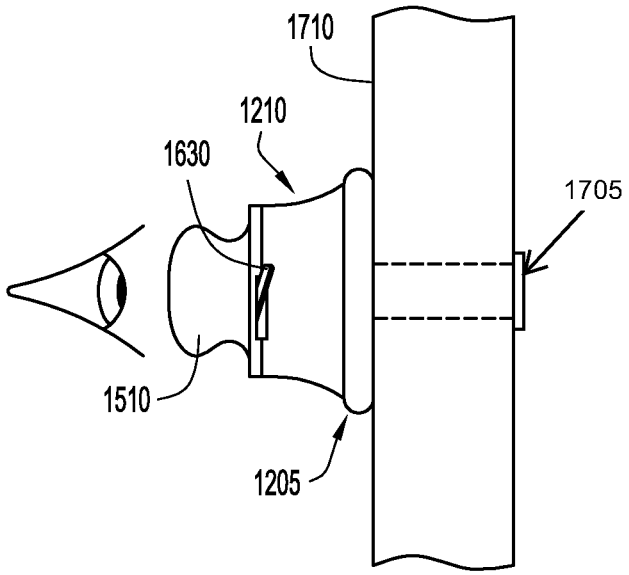

The operation of the device is explained with reference to FIG. 17A and 17B. Initially, the base member 1205 is aligned with a peephole 1705 on a door 1710 such that the base member is generally coaxial with the peephole viewing lens. The base member 1205 is secured to the door (e.g., by removing releasing paper and pressing the base member against the surface of the door). Once the base member 1205 is secured to the door, the shutter assembly is coupled to the base member. Specifically, the shutter assembly 1210 is aligned with the base member 1205 and rotationally oriented to position the locking tabs 1530A, 1530B, 1530C adjacent the hook openings 1415. The shutter assembly 1210 is urged axially onto the base member 1205, and then rotated (e.g., rotated clockwise from the viewpoint of FIG. 17B) such that the locking tabs 1530A-1530C slide under the hooks 1330A-1330C. To remove the shutter assembly 1210, the process is reversed, with the shutter assembly being rotated in an opposite direction (e.g., counterclockwise) until the locking tabs 1530A-1530C clear the hooks 1330A-1330C. Once clear, the shutter member 1210 is drawn away from the base member, disengaging/decoupling the components.

In operation, the device 1200 begins in its normal, closed position, in which the repositionable shield 1555 cooperates with the fixed shield 1550 to cover the aperture 1610 in the housing 1515. To securely view objects through the peephole, the user places an eye against the eyecup 1510, and then pivots the actuator 1630 to place the device in its viewing position. Specifically, the actuator 1630 is pivoted to drive the disc 1625 radially outward such that the disc passes through the slot 1527 and partially or completely clears (is no longer aligned with) the aperture 1610. As noted above, the disc 1625 may be rotated until the second stop member 1645 engages the housing wall proximate the slot 1527. Thus, in its normal position, the disc 1625 may be completely housed within the housing. In the viewing position, the disc 1625 extends partly out of the housing 1515 through the slot 1527.

In its viewing position, the viewer can now see through the security device 1200 and the peephole 1705. The repositionable shield 1555 (and, optionally, the actuator 1630) possesses a thickness that is slightly less than the width of the slot 1527; consequently, it prevents the penetration of light into the housing 1515 via slot. Once viewing is complete, the user simply releases the actuator 1630, allowing gravity to return the shield 1555 to its normal, closed position. Alternatively, the user may manually rotate the actuator 1635 in a reverse direction, which pivots the repositionable shield 1555 back to its normal, closed position. The user may now remove the eye from the eyecup 1510.

Figure 18A:
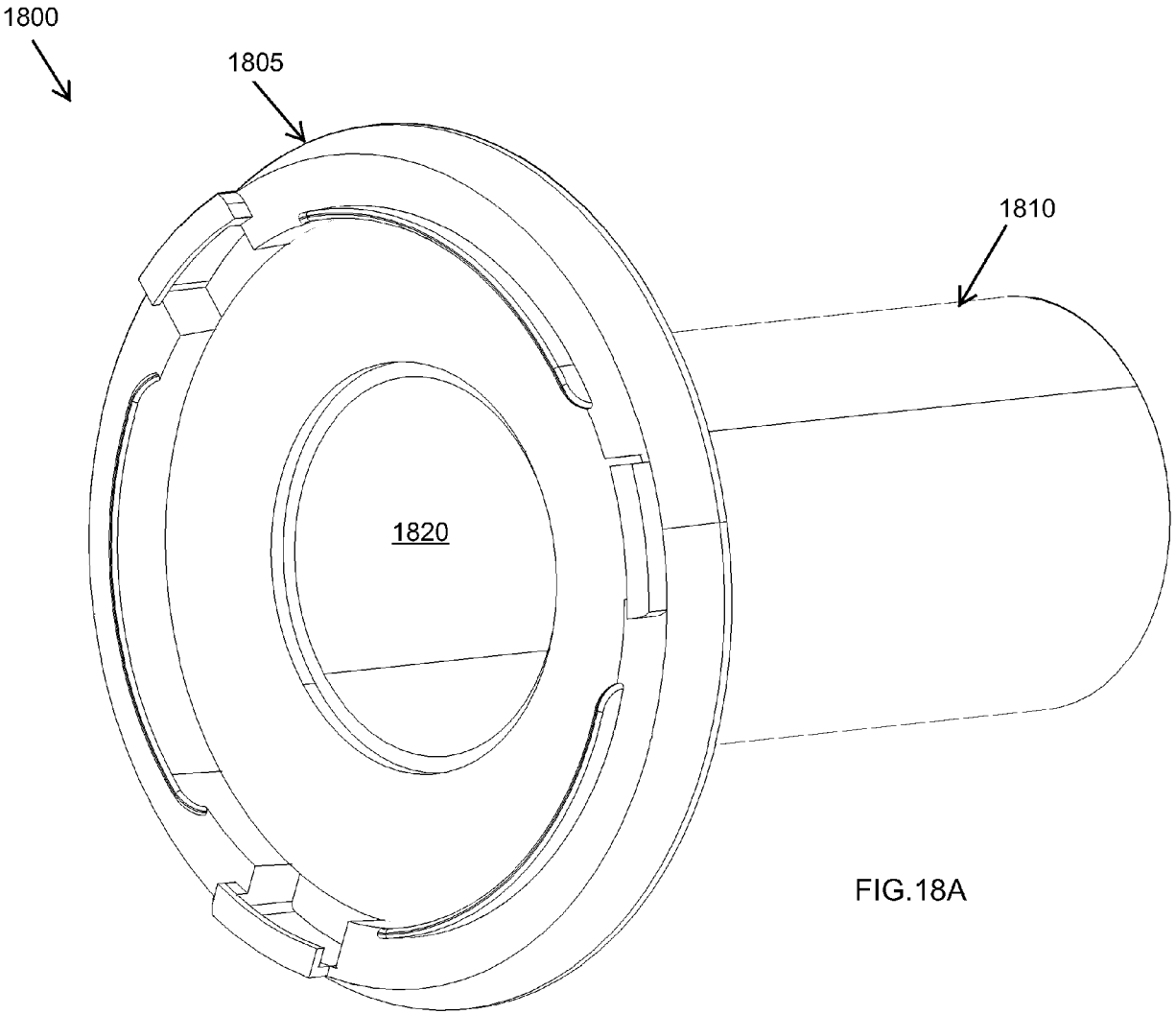
FIGS. 18A and 18B illustrate the security cover shown in FIG. 12A, further adapted for use as a peephole.
Figure 18B:
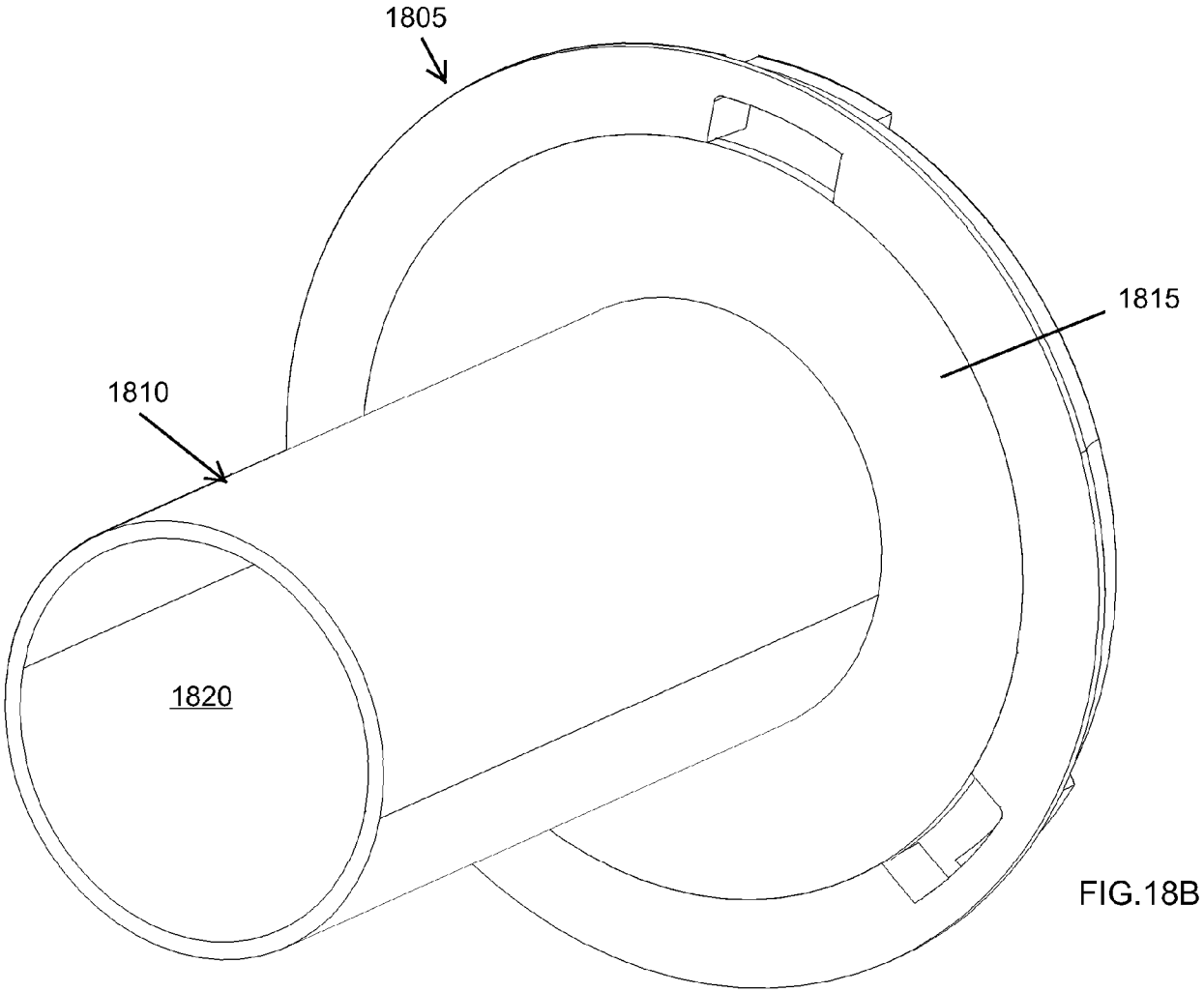

FIGS. 18A and 18B illustrate a security device in accordance with another aspect of the invention. As illustrated, the device 1800 includes a base member portion 1805 and an elongated shaft portion 1810 extending distally from the door-facing side 1815 of the base member. The shaft 1810 is a hollow right cylinder defining a central channel 1820. The base member portion 1805 includes the same structure as described above (FIG. 13). Similarly, the shutter assembly 1210 includes the same structure as that described above (FIGS. 15 and 16). With this configuration, the device 1800 itself functions as a door viewer or peephole, with the shaft 1810 extending through the transverse dimension of the door (e.g., the device 1800 may be used to retrofit an existing peephole). While the integrated peephole design is illustrated without lenses, it should be understood that the lenses (e.g., a system of wide-angled lenses) may be housed in the shaft to increase the viewing angle of area along the exterior surface of the door. While not illustrated, it should be understood that the hollow shaft may include a lens system, i.e., one or more lenses operable to provide a wider field of view than when no lens is present.

Figure 19:
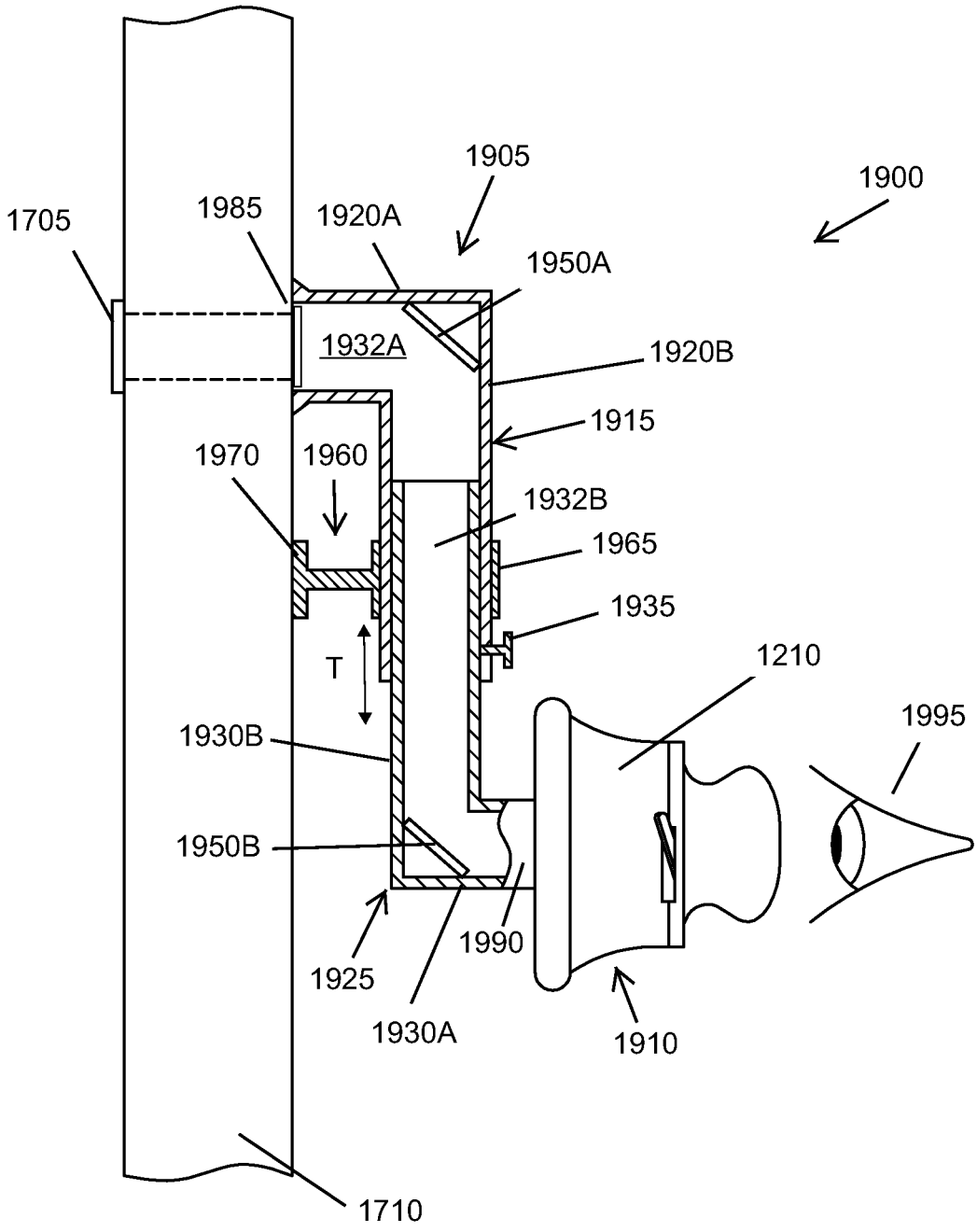
FIG. 19 illustrates a cross sectional view of a security cover for a door viewer in accordance with an aspect of the present invention.

FIG. 19 illustrates a security cover for a door viewer in accordance with another embodiment of the invention. In this embodiment, the security cover assembly 1900 accommodates users of various heights, e.g., enabling viewer shorter than the peephole height (such as a child) to look through a peephole 1705. As shown, the assembly 1900 includes a periscope 1905 and a shutter assembly 1910 similar to that described above. The periscope 1905 includes a first L-shaped member or tube 1915 including a short arm 1920A and a long arm 1920B, as well as a second L-shaped member or tube 1925 similarly including a short arm 1930A and a long arm 1930B. The L-shaped members 1915, 1925 are generally hollow defining first 1932A and second 1932B L-shaped channels, respectively. The L-shaped members 1915, 1925 are telescopically coupled such that the long arm 1930B of the second member 1925 slides within the long arm 1920B of the first member 1915, axially sliding relative to the first member. With this configuration, the overall length of the periscope 1905 may be selectively adjusted (indicated by arrow T) by axially repositioning the second member 1925 with respect to the first member 1915.

The periscope further includes a fastener 1935 operable to secure the position of the second member 1925 with respect to the first member 1915. By way of example, the fastener 1935 may include a threaded bolt that passes through the first member 1915 to frictionally engage the second member 1925, thereby prevent the sliding of the second member with respect to the first member. In other embodiments, the fastener 1935 may be a spring biased tab (e.g., a valco tab) disposed on the second member 1925 that is configured to protrude through a series of axially aligned holes formed into the first member 1915 when aligned therewith.

Each of the first member 1915 and the second member 1925 may include one or more refractive or reflective elements. In an embodiment, the first member 1915 includes a first reflective or refractive element 1950A disposed along the bend of the first L-shaped channel 1932A and the second member 1925 includes a second reflective or refractive element 1950B disposed along the bend of the second L-shaped channel 1932B. With this configuration, the first refractive or reflective element 1950A is disposed generally aligned with (along first and second long arms) and generally parallel to the second refractive or reflective element 1950B. The refractive or reflective elements 1950A, 1950B may be in the form of a mirror (e.g., disposed at 45° angle), a prism or a combination thereof. With this configuration, the periscope 1905 directs the image viewed through the peephole 1705 out through the shutter assembly 1910. While two refractive or reflective elements are illustrated, it should be understood the members 1915, 1925 may include any arrangement (number and/or positioning) of prisms, minors, and lenses.

The assembly 1900 may further include a brace or bracket 1960 operable to secure the assembly to and or stably support the assembly on the door. The brace 1960 may include a coupling ring 1965 that engages the telescoping members 1915, 1925 and a T-shaped support 1970 that contacts the door 1710 to orient the long arms 1920B, 1930B generally parallel to the door surface. Either end of the periscope 1905, as well as the brace 1960, may be further adapted such that it may be releasably attached to the door 1710 (e.g., via adhesive, etc.).

In another embodiment, the short arms 1920A, 1930A and/or the long arms 1920B, 1930B could also include telescoping segments that are selectively extended or collapsed or extended to alter the distance (the horizontal distance) between the assembly 1900 and the door 1710.

In operation, the assembly 1900 is coupled to the door 1710 proximate a peephole 1705 by positioning the opening 1985 of the first member short arm 1920A over the peephole. The shutter assembly 1210, which may be similar to that described above, is coupled to the opening 1990 defined by second member short arm 1930A. The user may adjust the periscope 1905 by engaging the fastener 1935 to release the second member 1925. The second member 1925 may be moved axially such that it telescopes in/out of the first member 1915 until the desired height is achieved. Once the desired height is achieved, the user 1995 may again engage the fastener to secure the members 1915, 1925 together. Once secure, the user may operate the shutter assembly 1210 as described above.

While the invention has been described in detail and with reference to specific embodiments thereof, it will be apparent to one skilled in the art that various changes and modifications can be made therein without departing from the spirit and scope thereof. For example, the shutter mechanism may include a gear system in which the first shutter member includes teeth that mesh with corresponding teeth on the second shutter member. Additionally, a shutter system may be incorporated into the eyecup portion. By way of example, the eyecup portion may be formed of generally resilient material and may include a generally resilient, internal diaphragm in communication with the rim 1547. The diaphragm includes generally resilient flaps or segments angularly spaced about the aperture (e.g., each flap may possess a generally triangular shape). The flaps are configured to rotate from a first or closed position in which the flaps are oriented generally orthogonal to eyecup channel (aperture) to a second position, in which the flaps are oriented generally parallel to the eyecup channel. Specifically, the diaphragm is configured such that, upon axial compression of the eyecup (e.g., when a user places an eye against the rim 1547 of the eyecup), the flaps are rotated forward from their closed position to their opened position.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

I claim:

1. A security cover device for a door viewer inserted into a door, the door viewer including a viewing port, the security device comprising:

an annular coupling member including a first, door-facing side and a second, viewer facing side, the coupling member configured to be directly coupled on an exterior surface of the door such that the first side of the coupling member contacts the exterior door surface; and a shutter assembly configured to releasably couple to the coupling member, the shutter assembly comprising:

a shutter housing including a first viewing aperture oriented generally coaxially with a second viewing aperture, a repositionable shutter member coupled to the shutter housing such that the shutter member is oriented between the first viewing aperture and the second viewing aperture, the shutter member being configured to alter an amount of light passing through the shutter housing, and an actuator in communication with the shutter member operable to reposition the shutter member with respect to the shutter housing from a first shutter member position to a second shutter member position, wherein the security cover device is configured to be oriented over the viewing port of the door viewer inserted into the door.

2. The security cover device of claim 1, wherein:

the shutter housing comprises a channel extending from the first viewing aperture to the second viewing aperture, the channel cooperating with the apertures to permit passage of light through the shutter housing;

in the first shutter member position, the shutter member is oriented such that the shutter member is aligned with at least one of the first aperture and the second aperture; and in the second shutter member position, the shutter member is oriented out of alignment with at least one of the first aperture and the second aperture, enabling a viewer to view through the shutter housing and the viewing lens of the door viewer.

3. The security cover device of claim 2, wherein:

the channel extending from the first viewing aperture to the second viewing aperture defines a channel surface; and the shutter assembly further comprises a fixed shield disposed within the channel and extending radially inward from the channel surface, wherein, in the first shutter member position, the shutter member cooperates with the fixed shield to inhibit light passage through the shutter housing.

4. The security cover device of claim 3, wherein:

the shutter member comprises a disc and the actuator comprises radial arm formed integrally with the disc.

5. The security cover device of claim 4, wherein:

the shutter housing comprises a door facing side and a viewer facing side, the door facing side being configured to couple to the coupling member; and the shutter assembly further comprises an eyecup including a flexible rim coupled to the viewer facing side of the shutter housing.

6. The security cover device of claim 5, wherein:

the shutter housing comprises a tab extending radially from an exterior surface of the housing proximate the door facing side of the shutter housing; and the second side of the coupling member comprises a hook that receives the tab, the hook receiving the tab to releasably capture the shutter housing to the coupling member.

7. The security cover device of claim 5, wherein:

the shutter housing comprises a generally annular body including a plurality of bosses angularly spaced about the body;

the coupling member comprises a generally annular body including a plurality of engagement hooks angularly spaced about the body, each engagement hook generally aligning with a corresponding boss on the shutter housing; and each engagement hook captures a corresponding boss to connect the shutter assembly to the base member.

8. The security cover device of claim 1, wherein:

the first side of the coupling member comprises an adhesive layer disposed on a surface of the coupling member, the adhesive layer operable to secure the coupling member to a surface of the door; and the second side of the coupling member includes a coupling mechanism operable to releasably engage the shutter assembly.

9. The security cover device of claim 1, wherein:

the shutter housing comprises a slot formed into a housing outer wall; and the actuator extends from the housing, passing through the slot.

10. The security cover device of claim 9, wherein engaging the actuator pivots the shutter member from the first shutter member position, in which the shutter member is positioned entirely within the housing, to the second shutter member position, in which at least a portion of the shutter member extends outward from the housing, passing through the slot.

11. A security cover device for a door viewer, the security cover comprising:

an annular coupling member including a first, door facing side and a second, viewer facing side, the first side being configured to directly couple to a door with a door viewer including a viewing port such that the coupling member is positioned on an exterior surface of the door and the security cover device covers the viewing port of the door viewer; and a shutter assembly configured to releasably couple to the coupling member second side, the shutter assembly comprising:

a shutter housing including:

a body comprising a channel extending from a first viewing aperture to a second viewing aperture, the first viewing aperture being generally coaxial with the second viewing aperture, and a slot formed into the housing, a repositionable shutter pivotally coupled to the shutter housing, the repositionable shutter including:

a shield portion operable to block light passing through the shutter housing, and an actuator portion extending through the shutter housing slot, wherein the actuator portion is engaged to reposition the shield portion from a first shutter position, in which the shield portion is positioned within the shutter housing such that the shield portion is aligned with the second viewing aperture, to a second shutter position, in which the shield portion does not align with the second viewing aperture; and a fixed shield disposed within the channel that extends radially inward from an interior surface of the shutter housing.

12. The security cover device of claim 11, wherein the shield portion is formed integrally with the actuator portion.

13. The security cover device of claim 11, wherein the shutter assembly further comprises an eyecup including a flexible rim disposed proximate the second viewing aperture.

14. The security cover device of claim 13, wherein:

the shutter housing comprises a locking tab extending radially from an exterior surface of the shutter housing; and the coupling member comprises a hook that receives the locking tab to capture the shutter assembly to the coupling member.

15. The security cover device of claim of claim 13, wherein:

the shutter housing comprises a generally annular body having a plurality of bosses angularly spaced about the body;

the coupling member comprises a generally annular body including a plurality of engagement hooks angularly spaced about the body, each engagement hook generally aligning with a corresponding boss on the shutter housing; and each hook captures its corresponding boss to connect the shutter assembly to the coupling member.

16. The security cover device of claim 15, wherein:

the first side of the coupling member defines a surface;

an adhesive layer covers the surface of the first side of the coupling member, the adhesive layer being operable to secure the base member to the exterior surface of the door; and the second side including a coupling mechanism operable to releasably engage the shutter assembly.

17. A method of securing a door viewer device installed on a door, the method comprising:

obtaining a security cover comprising:

an annular coupling member including a first side and a second side, the first side adapted to directly couple to the door with a door viewer, a shutter assembly configured to releasably couple to the coupling member along coupling member second side, the shutter assembly comprising:

a shutter housing including a first viewing aperture oriented generally coaxially with a second viewing aperture, a repositionable shutter member disposed within the shutter housing such that the shutter member is oriented between the first viewing aperture and the second viewing aperture, the shutter member being configured to alter the amount of light passing through the housing, and an actuator in communication with the shutter member to selectively reposition the shutter member with respect to the housing from a first shutter position to a second shutter position;

directly coupling the coupling member to the door;

coupling the shutter assembly to the coupling member such that the security cover device is oriented over a viewing port of the door viewer inserted into the door; and engaging the actuator to reposition the shutter member from the first shutter position to the second shutter position.

18. The security cover device of claim 1, wherein the shutter housing further includes a stop member operable to prevent the rotation of the repositionable shutter member beyond a predetermined rotational position.

19. The security cover device of claim 1, wherein the shutter assembly includes:

a first stop member to prevent rotation of the repositionable shutter member beyond a predetermined rotational position as the shutter member travels in a first direction; and a second stop member configured to prevent rotation of the repositionable shield member beyond a predetermined rotational position as the shutter member travels in a second direction.

20. The security cover device of claim 11, wherein the fixed shield is a C-shaped planar member.

* * * * *